US006463766B2

(12) United States Patent
Kubota et al.

(10) Patent No.: US 6,463,766 B2
(45) Date of Patent: Oct. 15, 2002

(54) WASHING MACHINE WITH MEANS FOR PREVENTING PROPAGATION OF MICROORGANISM

(75) Inventors: Tooru Kubota, Seto (JP); Takayoshi Iwai, Seto (JP); Tsutomu Hatayama, Seto (JP); Kenji Kojima, Seto (JP); Tadaaki Koketsu, Gifu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 87 days.

(21) Appl. No.: 09/770,241

(22) Filed: Jan. 29, 2001

(65) Prior Publication Data

US 2001/0010165 A1 Aug. 2, 2001

(30) Foreign Application Priority Data

Jan. 28, 2000 (JP) ..... 2000-020094
May 26, 2000 (JP) ..... 2000-156945

(51) Int. Cl.[7] ..... D06F 39/02
(52) U.S. Cl. ..... 68/12.18; 68/17 R
(58) Field of Search ..... 68/12.18, 17 R, 68/207

(56) References Cited

U.S. PATENT DOCUMENTS 4,795,032 A * 1/1989 Kandathil ..... 8/158 X
5,932,531 A * 8/1999 Oberlander et al. ..... 510/312

FOREIGN PATENT DOCUMENTS

JP 08026917 A 1/1996
JP 11244581 A 9/1999
JP 11256199 A 9/1999

* cited by examiner

*Primary Examiner*—Philip R. Coe
(74) *Attorney, Agent, or Firm*—Pillbury Winthrop LLP

(57) ABSTRACT

A washing machine includes a wash tub, a water-supply mechanism for supplying water into the wash tub, and a disposition section in which a solid antimicrobial agent containing an organic compound having a nitrogen-halogen atomic combination is disposed. The disposition section is provided in the water-supply mechanism. The antimicrobial agent is brought into contact with water thereby to release hypohalogenous acid into the water.

18 Claims, 17 Drawing Sheets

| CONCENTRATION OF HYPOCHLOROUS ACID (PPM) | NUBER OF FUNGI (CFU/ml) |
|---|---|
| 0 | $5\times10^5$ |
| 0.1 | $3\times10^2$ |
| 0.2 | $2\times10^2$ |
| 0.5 | $1\times10^2$ |
| 1.0 | NOT DETECTED |
| 2.0 | NOT DETECTED |

WASHING MACHINE WITH MEANS FOR PREVENTING PROPAGATION OF MICROORGANISM

BACKGROUND OF THE INVENTION

1. Field of the Invention

This invention relates a washing machine provided with means for preventing propagation of microorganism such as fungi and bacteria so that laundry can sanitarily be washed.

2. Description of the Prior Art

Household washing machines have conventionally been constructed so that a suitable amount of detergent and a predetermined amount of water from a service water line are supplied into a wash tub containing laundry to be washed, and agitation is subsequently caused in the wash tub in order that the laundry may be cleaned. A calcium component contained in the service water acts upon a surface active agent contained in the detergent such that an insoluble metal soap is produced. Parts of the metal soap adhere to the wash tub. Production of the metal soap is conspicuous when soap powder comprising a higher fatty acid sodium is used as the washing detergent.

An automatic washing machine usually has a double tub structure, namely, comprises an outer water-receiving tub and an inner wash tub provided in the water-receiving tub and also serving as a spinning tub for dehydration. In this type of washing machine, the laundry is not brought into contact with an outer circumferential face of the wash tub and an inner circumferential face of the water-receiving tub although washing liquid is caused to flow through a space defined therebetween. accordingly, the metal soap adheres to the outer circumferential face of the wash tub and the inner circumferential face of the water-receiving tub to be piled up.

When the metal soap is piled up on the outer circumferential face of the wash tub etc., as described above, flocks or stains separated from the laundry easily adhere to the piled metal soap, whereupon a complex of the metal soap, flocks, stains, etc., is produced in the wash tub. When adhering to the complex, spores of fungi (mold) grow up into sporophytes which produce spores causing stains. The spores further produce an offensive smell due to metabolite. Additionally, the complex with mold adherent thereto comes off from the wash tub thereby to adhere to the laundry.

The water-receiving tub and the wash tub cannot usually be disassembled for cleaning by an ordinary user. Further, since reinforcing ribs are provided on the wash and water-receiving tubs for reinforcement, surfaces of these tubs are rugged. Accordingly, the metal soap is easily piled up on these tubs.

On the other hand, spores of a number of fungi contained in a human body and in an open air are adherent to the laundry (clothes). The spores remain in the wash tub after the laundry has been washed out. This results in an increased time for drying the laundry. Further, when the laundry is left wet for a long time, the spores adherent to the laundry grow up such that the laundry is tinged with yellow or smells offensive.

Water used for the bathing purpose is sometimes re-used for the clothes washing purpose in Japan. Recent automatic washing machines are provided with a washing course in which water remaining in a bathtub is supplied into the washing machine so as to be used for washing for the purpose of water saving. However, since the remaining water is considered to contain a number of fungi, the laundry is tinged with yellow or smells offensive more easily in the case where the remaining water is used for washing than in the case where the water from the service water line is used for washing.

SUMMARY OF THE INVENTION

Therefore, an object of the present invention is to provide a washing machine in which propagation of fungi can be prevented in the wash tub and the laundry can be prevented from being tinged with yellow or smelling offensive such that the laundry can sanitarily be washed.

The present invention provides a washing machine comprising a wash tub, a water-supply mechanism for supplying water into the wash tub, and a disposition section in which a solid antimicrobial agent containing an organic compound having a nitrogen-halogen atomic combination is disposed, the disposition section being provided in the water-supply mechanism, the antimicrobial agent being brought into contact with water thereby to release hypohalogenous acid into the water.

The fungi adherent to the wash tub and/or the laundry can be prevented from propagation since the water containing hypohalogenous acid is supplied into the wash tub in the aforesaid washing machine. Consequently, the laundry can sanitarily be washed.

In a first preferred form, the organic compound comprises any one or a mixture of a brominated hydantoine compound, a chlorinated hydantoine compound, and an iodinated hydantoine compound. Further, the organic compound preferably comprises a brominated isocyanuric compound.

In a second preferred form, the water-supply mechanism includes a water-supply path for supplying the water from a water source to the wash tub, and the disposition section is provided in the midst of the water-supply path. In this construction, the washing machine further comprises a filter provided downstream with respect to a portion of the water-supply path on which the disposition section is provided. When the antimicrobial agent is collapsed and part of the agent flows with water into the wash tub thereby to adhere to laundry, there is a possibility that the laundry may be decolorized. The aforesaid construction, however, can prevent the antimicrobial agent from flowing into the wash tub.

In a third preferred form, the water-supply mechanism includes a water-supply path for supplying the water from a water source to the wash tub, and the water-supply path includes a antimicrobial water supply path provided with the disposition section and an normal water supply path provided with no disposition section. The antimicrobial water supply path or the normal water supply path can be selected according to a degree of soil in the laundry, for example. In this case, the washing machine preferably comprises a control device selectively executing an antimicrobial water supply mode in which water having passed through the antimicrobial water path is supplied into the wash tub in a wash or rinse step and a normal water supply mode in which water having passed through the normal water path in the wash or rinse step. The control device preferably carries out the wash step or rinse step under the antimicrobial water supply mode for a longer time than under the normal water supply mode. In this arrangement, water containing hypohalogenous acid is supplied through the antimicrobial water path into the wash tub in the antimicrobial water supply mode so that the wash or rinse step is carried out. Since the wash or rinse step is performed for a longer period of time than under the normal water supply mode, the hypohalogenous acid can sufficiently accomplish the antimicrobial function.

In a fourth preferred form, the control device supplies into the wash tub the water having passed through the normal water supply path and thereafter supplies into the wash tub the water having passed through the antimicrobial water supply path under the antimicrobial water supply mode. Consequently, water containing high concentration of hypohalogenous acid can be diluted via the antimicrobial water supply path.

In a fifth preferred form, the washing machine further comprises a measuring element measuring a number of times of a antimicrobial water supply operation in which the water is supplied through the antimicrobial water supply path into the wash tub and an informing element informing that the number of times of the antimicrobial water supply operation measured by the measuring element has reached a limit number of times. Alternatively, the washing machine may further comprise a timing element measuring a time of an executed antimicrobial water supply operation in which the water is supplied through the antimicrobial water supply path into the wash tub and an informing element informing that the time measured by the timing element has reached a limit time. When the number of times or the time, of period of contact of the antimicrobial agent with water reaches a predetermined limit value, an organic compound contained in the antimicrobial agent is consumed such that hypohalogenous acid is not released. Accordingly, the antimicrobial agent needs to be supplemented or replaced by a new one. The aforesaid arrangement can reliably inform the user of a time for supplement or redisposition of the antimicrobial agent.

In a sixth preferred form, the water-supply mechanism includes a bathwater supply path provided for supplying bathwater into the wash tub and the disposition section is provided in a midst of the bath water supply path. Generally speaking, the bathwater contains a larger number of fungi than normal service water. The aforesaid construction, however, can limit propagation of fungi in the bathwater.

In a seventh preferred form, the antimicrobial agent has a predetermined dissolving speed when a water is at 25° C., the dissolving speed being set so that an effective concentration of chloride contained in the water after contact with the antimicrobial agent is increased in a range of 0.1 ppm and 10 ppm relative to an effective concentration of chloride contained in the water before the contact with the antimicrobial agent. It is known that the antimicrobial effect is conspicuous when the concentration of chloride contained in wash liquid is at or above 0.5 ppm. Further, the concentration of chloride contained in service water is generally at or above 0.4 ppm. On the other hand, chloride produces strong smell when the concentration thereof is excessively high. The strong smell renders the user unpleasant. In the aforesaid arrangement, however, the concentration of chloride can be adjusted so that sufficient effect can be achieved without production of strong smell.

In an eighth preferred form, the water-supply mechanism includes a water-supply path for supplying the water from a water source to the wash tub, the water-supply path is provided with a water reservoir, and the disposition section is provided in the water reservoir. When water is reserved in the water reservoir, the antimicrobial agent in the reserved water releases hypohalogenous acid. Thus, the concentration of hypohalogenous acid contained in the water supplied into the wash tub can be adjusted by adjustment of a time for which the water is reserved in the water reservoir.

In a ninth preferred form, the washing machine further comprises a cassette case allowing water to pass therethrough and detachably attached to the disposition section. In this construction, the antimicrobial agent is accommodated in the cassette case. Consequently, the antimicrobial agent can be treated without direct touch therewith by hand.

In a tenth preferred form, the water-supply mechanism includes a bathwater supply path provided for supplying bathwater into the wash tub and a tap water supply path provided for supplying tap water into the wash tub. In this construction, the washing machine further comprises a control device selectively executing a bathwater supply operation in which water having passed through the bathwater supply path is supplied into the wash tub and a tap water supply operation in which water having passed through the tap water supply path. In this case, a concentration of hypohalogenous acid contained in the water in the wash water during the bathwater supply operation is set to be higher than a concentration of hypohalogenous acid contained in the water in the wash tub during the tap water supply operation.

In an eleventh preferred form, the antimicrobial agent contains a rust-proofing component for a material of iron system. The iron material can be prevented from being rusted by a strong acidifying force of the hypohalogenous acid released from the antimicrobial agent.

BRIEF DESCRIPTION OF THE DRAWINGS

Other objects, features and advantages of the present invention will become clear upon reviewing the following description of preferred embodiments, made with reference to the accompanying drawings, in which.

DETAILED DESCRIPTION OF THE PREFERRED EMBODIMENTS

Figure 1:
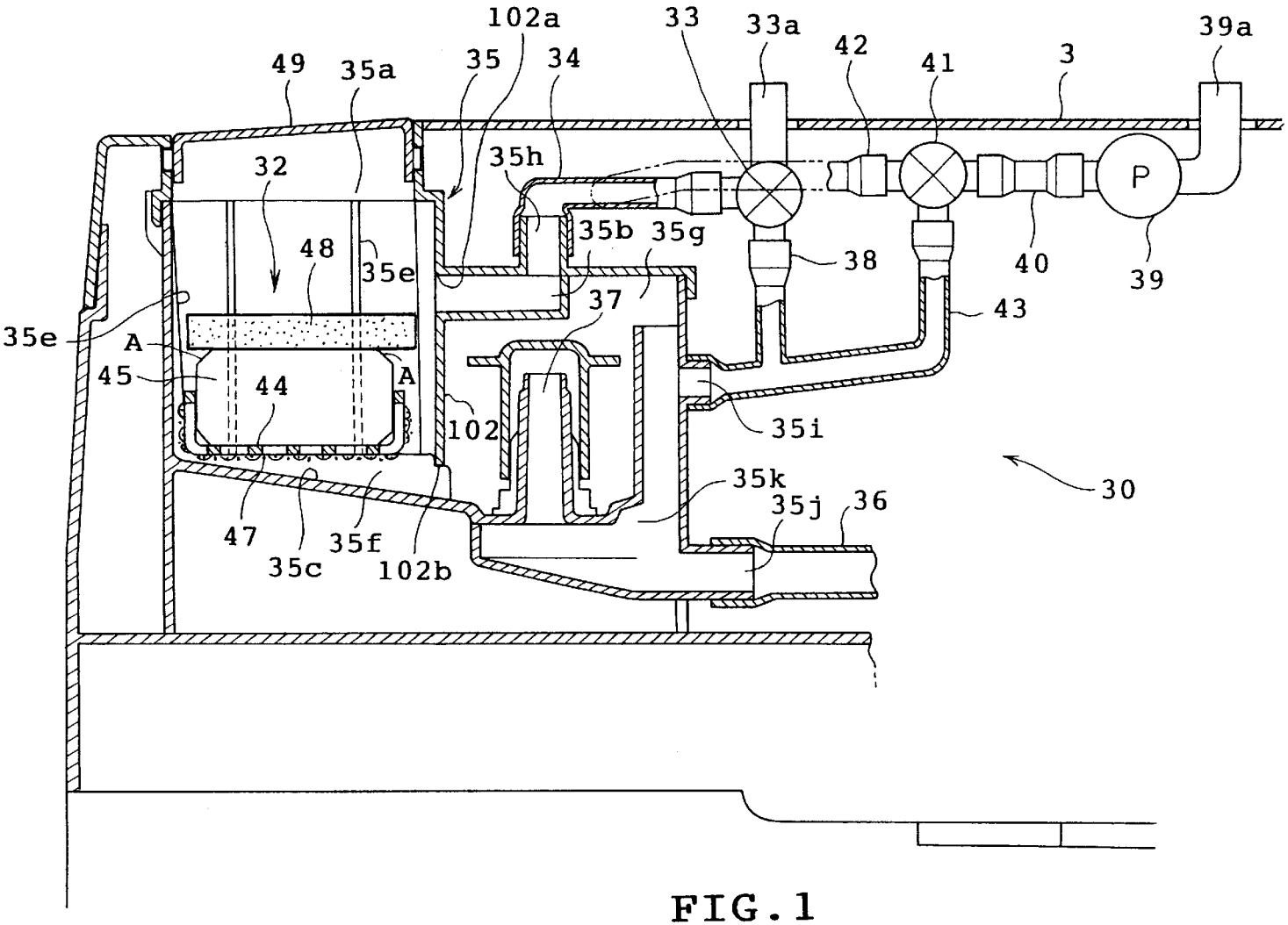
FIG. 1 is a longitudinal section of a water-supply mechanism of a washing machine of a first embodiment in accordance with the present invention.
Figure 2:
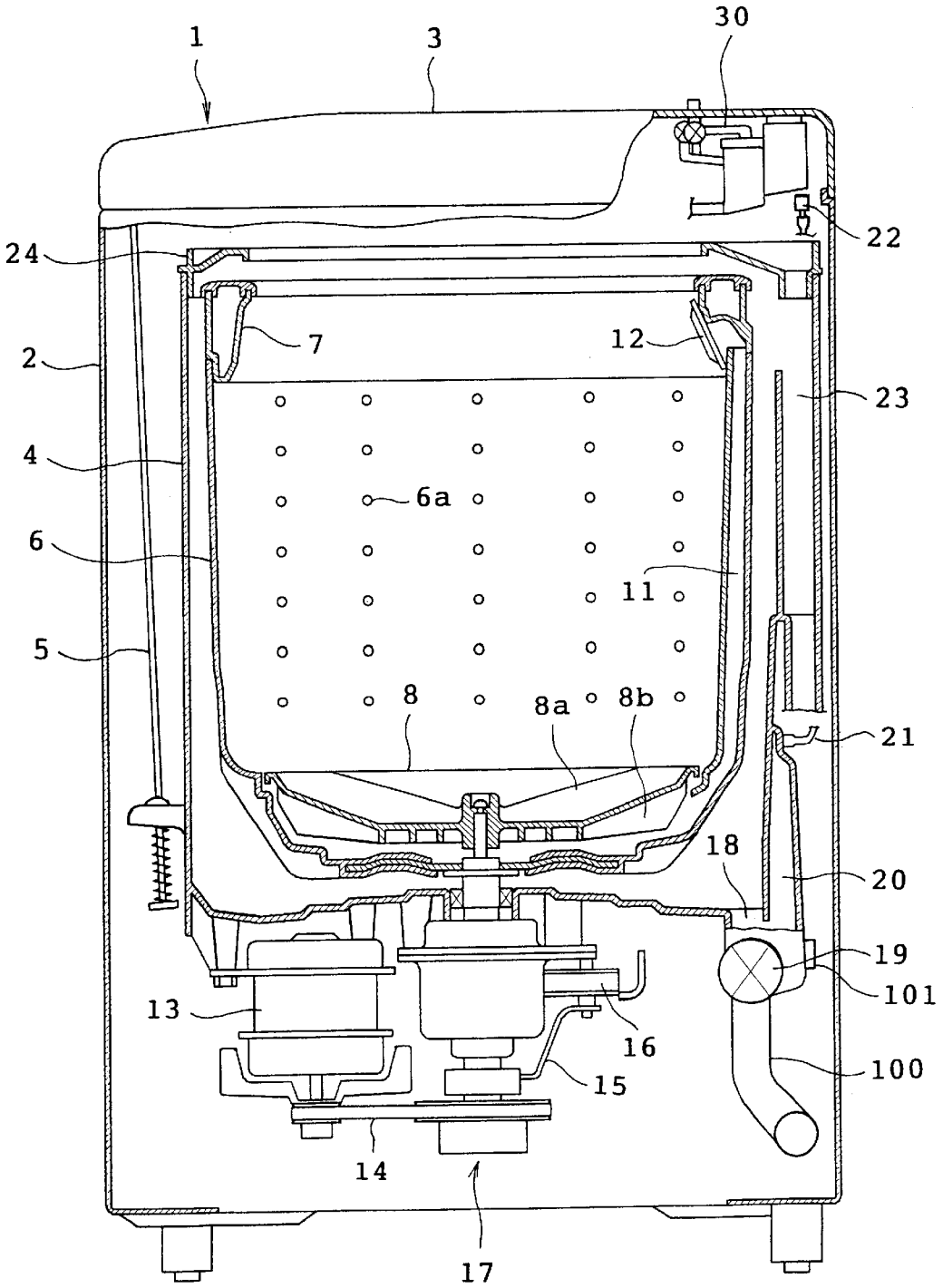
FIG. 2 is a longitudinally sectional side view of the washing machine.

Several embodiments of the present invention will be described with reference to the accompanying drawings. FIGS. 1 to 9 illustrate a first embodiment. Referring first to FIG. 2, a washing machine of the first embodiment is shown. The washing machine comprises a body 1 including an outer cabinet 2 formed into the shape of a generally rectangular box and a top cover 3 mounted on the top of the outer cabinet 2. The top cover 3 is formed into the shape of a generally thin hollow box. A water-receiving tub 4 is supported on elastic suspension mechanisms 5 in the outer cabinet 2. A wash tub 6 serving as a dehydration tub is rotatably mounted in the water-receiving tub 4.

The wash tub 6 has a circumferential wall formed with a number of dehydration holes 6*a*. A balancing ring 7 filled with a liquid, for example, is mounted on an upper end of the wash tub 6. An agitator 8 is rotatably mounted on the bottom of the wash tub 6. The agitator 8 has an upper radial vane 8a and a lower radial vane 8*b*. The wash tub 6 has a pumping path 11 formed along the circumferential wall thereof. A filter 12 is attached to an upper end of the water-supply path 12. When the agitator 8 is rotated in a wash or rinse operation, wash liquid in the wash tub 6 is pumped up through the pumping path 11 by the pumping action of the vane 8*b* of the agitator so that the wash liquid is caused to rise from a lower end of the path toward an upper end thereof. The wash liquid is then caused to return through the filter 12 into the wash tub 6. At this time, fiber lint, dust, etc. contained in the wash liquid are captured by the filter 12.

A drive mechanism 17 is provided below the water-receiving tub 4 in the outer cabinet 2. The drive mechanism 17 includes an electric motor 13 serving as a driving source, a belt transmission mechanism 14, a clutch mechanism 15, and a brake mechanism 16. The water-receiving tub 4 has a drain hole 18 formed through the bottom thereof. A drain valve 19 and a drain hose 100 are connected to the drain hole 18. A turbidity sensor 101 is provided in the drain hole 18 for detecting a turbidity of the wash liquid collected in the drain hole 18. The turbidity sensor 101 comprises an optical sensor detecting a transmittance of wash liquid, for example. The drain hole 18 is provided with an air trap 20. A pressure in the air trap 20 is transmitted through an air tube 21 to a water level sensor 22 provided for detecting a water level in the water-receiving tub 4 (the wash tub 6) as well known in the art. The water level sensor 22 is mounted in the hollow interior of the top cover 3. An outside of the circumferential wall of the water-receiving tub 4 defines an overflow path 23. An annular tub cover 24 is attached to an inner circumferential face of the upper end of the water-receiving tub 4.

Figure 3:
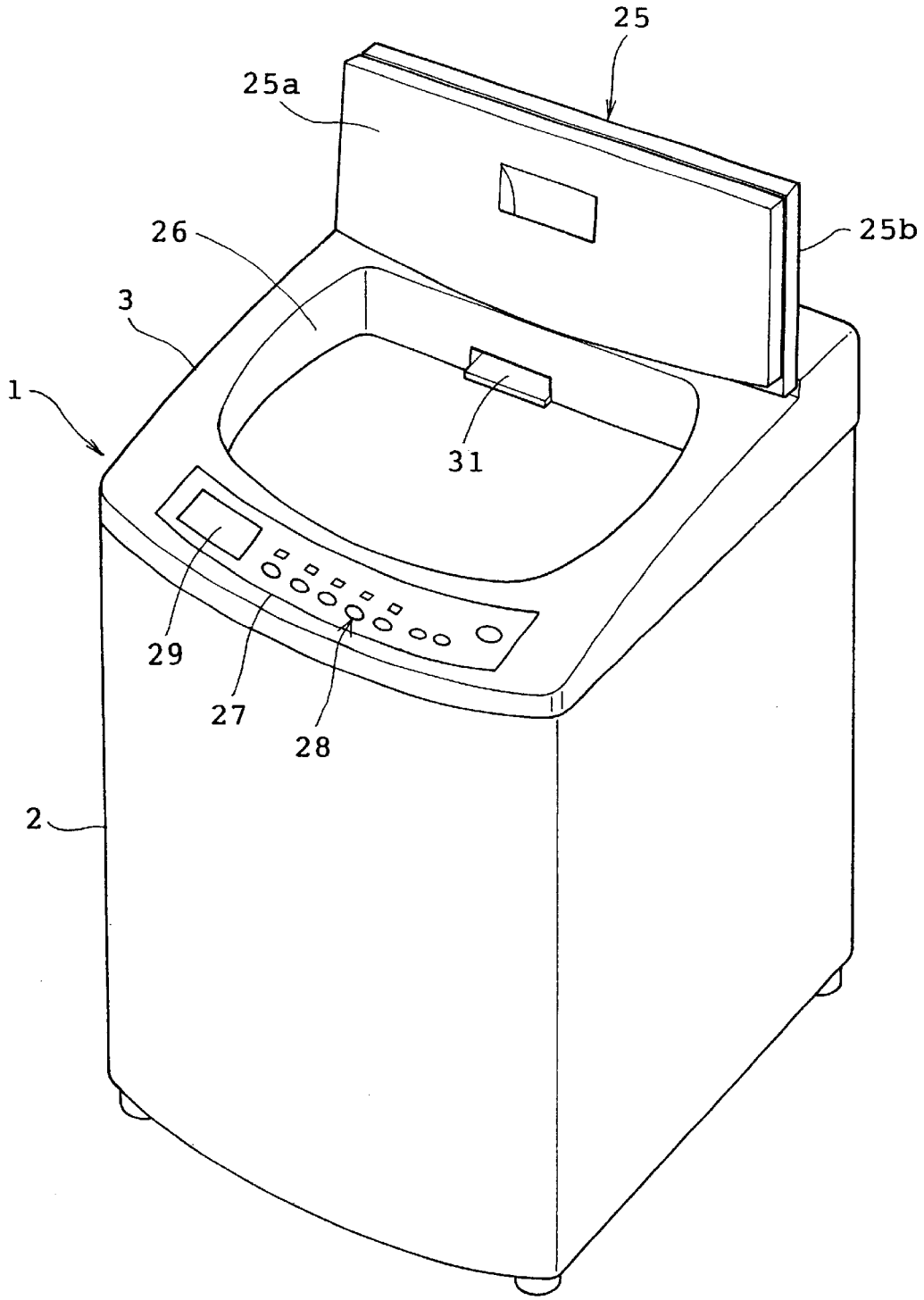
FIG. 3 is a perspective view of the washing machine.

Referring now to FIG. 3, the top cover 3 has a centrally formed generally circular access hole 26 through which laundry is put into and taken out of the wash tub 6. A foldable lid 25 is mounted on the top of the top cover 3 so as to close and open the access hole 26. The foldable lid 25 includes a front lid 25*a* and a rear lid 25*b* which are connected to each other. An operation panel 27 is mounted on a front top of the top cover 3 and includes a number of operation switches 28 and a display section 29. Further, a water-supply mechanism 30 is provided 4 in the rear interior of the top cover 3 for supplying water into the wash tub 6 as shown in FIG. 2. The top cover 3 has a water pouring outlet 31 formed in a rear of the access lid 26. The water-supply mechanism 30 supplies water through the outlet 31 into the wash tub 6.

Returning to FIG. 1, the water-supply mechanism 30 will be described in detail. A water-supply case 35 is provided in a left-hand end interior of the top panel 3. A water-supply valve 33 for tap water and a water-supply valve 41 for bathwater, and a bathwater pump 39 are provided on the right of the water-supply case 35. The valve 33 has a valve inlet 33*a* extending over the top of the top panel 3, and a distal end of the valve 33 is connected to a hose (not shown) further connected to a tap (not shown) of the service water line serving as a water source. Further, the valve 33 has two valve outlets to which pipes 34 and 38 are connected respectively. The pipe 34 is connected to a first water inlet 35*h* of the water-supply case 35.

The valve 41 has a valve inlet connected via a pipe 40 to a discharge section of a suction pump 39. The suction pump 39 has a suction section 39*a* extending over the top of the top panel 3, and a distal end of the suction section 39*a* is connected to a suction hose (not shown) provided for pumping up bathwater from a bath serving as a water source. Pipes 42 and 43 are connected to two valve outlets of the valve 41 respectively. The pipe 42 is connected to the midst of the pipe 34 whereas the other valve 43 is connected to a second water inlet 35*i* of the water-supply case 35. Further, the pipe 38 is connected to the midst of the terminal section of the pipe 38.

The interior of the water-supply case 35 is partitioned by a partition wall 102 into an antimicrobial agent chamber 35*a* and a siphon chamber 35*g*. The partition wall 102 has two through holes 102*a* and 102*b* formed in upper and lower portions thereof respectively. The antimicrobial agent chamber 35*a* has a bottom 35*c* inclined downward toward the hole 102*b*. A siphon pipe 37 is provided in the siphon chamber 35*g*. A water passage 35*b* is provided in an upper interior of the siphon chamber 35*g* so as to communicate with hole 102*a* and the water inlet 35*h*. The siphon chamber 35*g* has a water outlet 35*j* formed through a lower portion thereof. A pipe 36 extending to the outlet 31 (see FIG. 3) is connected to the water outlet 35*j*. A water path 35*k* is provided in the siphon chamber 35*g* so as to communicate with the water inlet 35*i* and the water outlet 35*j*, and the siphon pipe 37 and the water outlet 35*j*.

In the above-described construction of the water-supply mechanism 30, tap water is caused to flow through the valve 33, the pipe 34 or the pipes 38 and 43 into the water-supply case 35. Thereafter, the tap water is supplied through the pipe 36 and outlet 31 into the wash tub 6. Furthermore, bathwater is caused to flow through the pipe 40, valve 41 and pipes 42 and 43 or pipe 43 into the water-supply case 35. Thereafter, the bathwater is supplied through the pipe 36 and outlet 31 into the wash tub 6. Accordingly, the water-supply path from the pipe 34 through the water-supply case 35 and pipe 36 to the wash tub 6 serves as a tap water supply path. The water-supply path from the pipes 38 and 43 through the water-supply case. 35 and pipe 36 to the wash tub 6 serves as another tap water supply path. Further, the water supply path from the pipes 40, 42 and 34 through the water-supply case 35 and pipe 36 to the wash tub 6 serves as a bathwater supply path. The water-supply path from the pipes 40 and 43 through the water-supply case 35 and pipe 36 to the wash tub 6 serves as another bathwater supply path.

Figure 4:
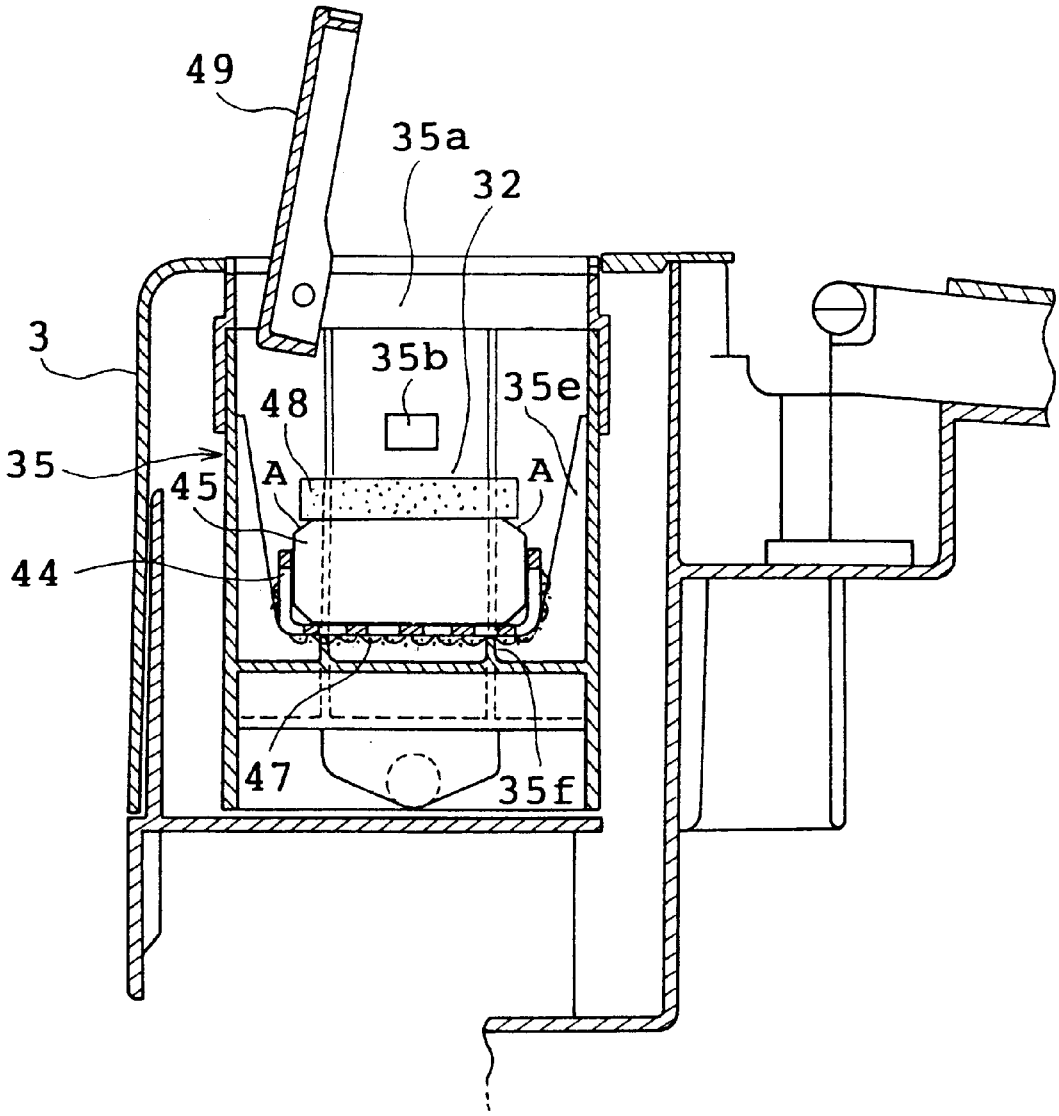
FIG. 4 is a longitudinally sectional side view of a accommodation chamber of a water-supply case.

Referring now to FIG. 4, a lid 49 made of a transparent material is mounted on the water-supply case 35 so as to close and open a top opening of the antimicrobial agent chamber 35*a*. The lid 49 is provided with a locking mechanism (not shown) so that an infant or child can be prevented from freely opening and closing the lid. On the bottom 35*c* of the chamber 35 stand a plurality of vertical ribs 35*e* and a plurality of horizontal ribs 35*f* (see FIG. 1) perpendicular to the vertical ribs. Each vertical rib 35*e* includes a central portion crossing the horizontal rib 35*f* and having an upper face co-planar with an upper face of each horizontal rib 35*f*.

A cassette case 44 is disposed on the upper portions of the ribs 35*e* and 35*f*. The cassette case 44 is taken out of the top opening of the chamber 35*a* when the lid 49 is opened. The cassette case 44 is formed into a net of large meshes. A filter 47 having on an outer periphery thereof a net of meshes each of which is at or less than 1 mm is attached to an outer peripheral face of the cassette case 44. A predetermined amount of solid antimicrobial agent 45 is accommodated in the cassette case 44. A spongy buffer member 48 having a water permeability is placed on the top of the solid antimicrobial agent 45. Thus, the antimicrobial agent 45 is put into the cassette case 44 to be supported by the ribs 35*e* and 35*f* with the outer surface thereof except its top being outwardly exposed. Accordingly, the ribs 35*e* and 35*f* serve as a disposition section.

Figure 6:
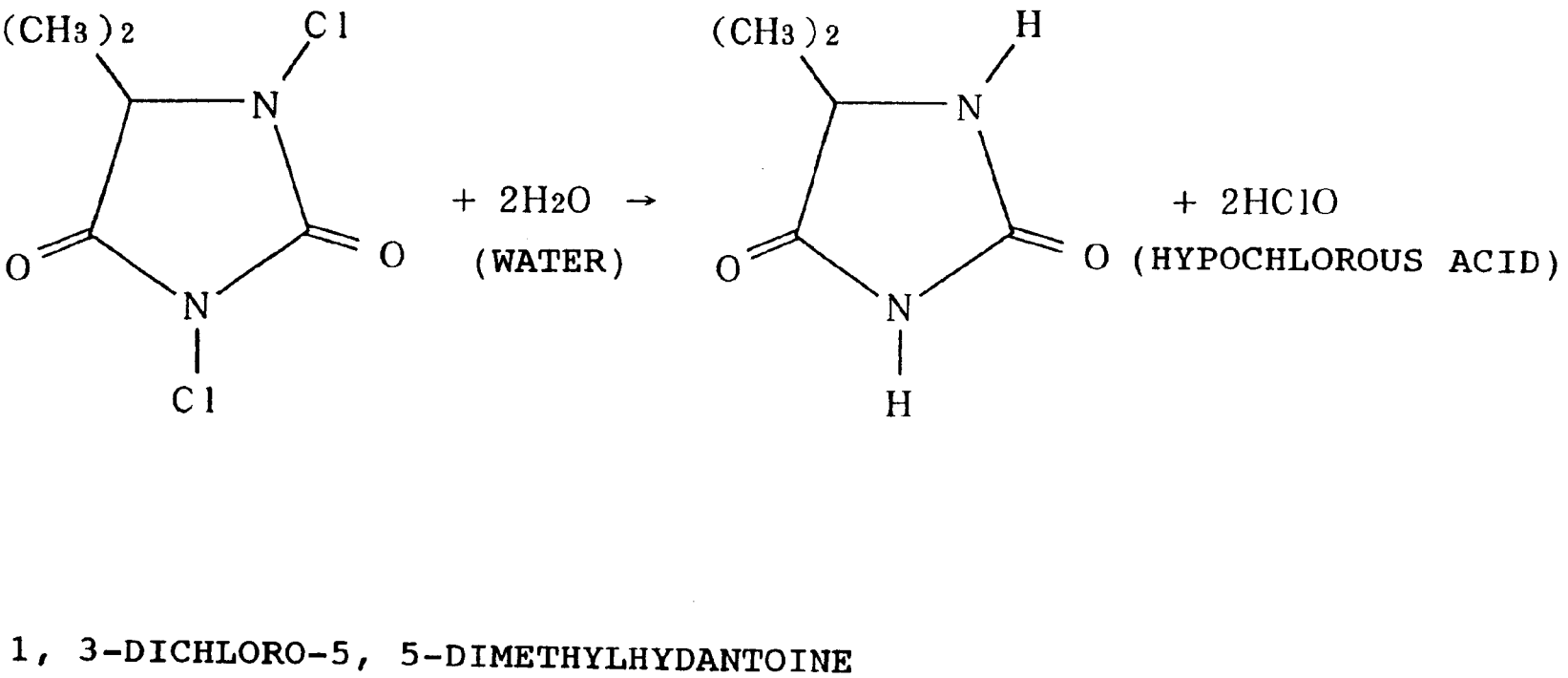
FIG. 6 shows hydrolysis of 1,3-dichloro-5,5-dimethylhydantoine.

The antimicrobial agent 45 will now be described in detail. The antimicrobial agent 45 is made by pressing a halogenated hydantoine compound to be solidified into the shape of a tablet. The antimicrobial agent 45 has corners each of which has a low binding and is chamfered so that each corner can be prevented from being easily collapsed. Furthermore, the chamfered corners can increase a surface area of the antimicrobial agent 45. The halogenated hydantoine compound is an organic compound having a nitrogen-halogen atom combination in a molecule. When brought into contact with water, the halogenated hydantoine compound is hydrolyzed thereby to gradually release hypohalogenous acid. In particular, it is known that the halogenated hydantoine compound releases the hypohalogenous acid for a long period of time since the halogenated hydantoine compound dissolves slowly when brought into contact with water. The halogenated hydantoine compound includes 1,3-dichloro-5,5-dimethylhydantoine, 1-bromo-3-dichloro-5,5-dimethylhydantoine, and 1,3-dichloro-5,5-ethylmethylhydantoine. As well known in the art, hypohalogenous acid and more particularly, hypochlorous acid, hypobromous acid, and hypoiodous acid each have an antimicrobial action due to oxidation. In the embodiment, the antimicrobial agent 45 comprises 1,3-dichloro-5,5-dimethylhydantoine. FIG. 6 shows hydrolysis of 1,3-dichloro-5,5-dimethylhydantoine. When the antimicrobial agent reacts to water, hypochlorous acid (2HClO) as hypohalogenous acid is produced.

The halogenated hydantoine compound is white. In the embodiment, a red pigment is added to the halogenated hydantoine compound so that the antimicrobial agent is colored. The reason for this is as follows: Components of a washing machine are usually made of a white resin. When colored in red, the antimicrobial agent 45 becomes conspicuous against the white components and the chamber 35*a* in particular. Since the lid 49 is made of a transparent material in the embodiment, the present or absence and a degree of consumption of the antimicrobial agent 45 can be confirmed without opening the lid 49. The hypohalogenous acid has a strong oxidizing force. In view of this, the ribs 35*e* and 35*f*, water-supply case 35, top cover 3, etc., which are resin moldings disposed around the antimicrobial agent 45, are made of a material which is not easily oxidized, for example, polypropylene, polyethylene, polychlorinated biphenyl or fluorine contained resin, whereupon these components around the antimicrobial agent 45 are prevented from deterioration or discoloration due to oxidation by the hypohalogenous acid.

Figure 5:
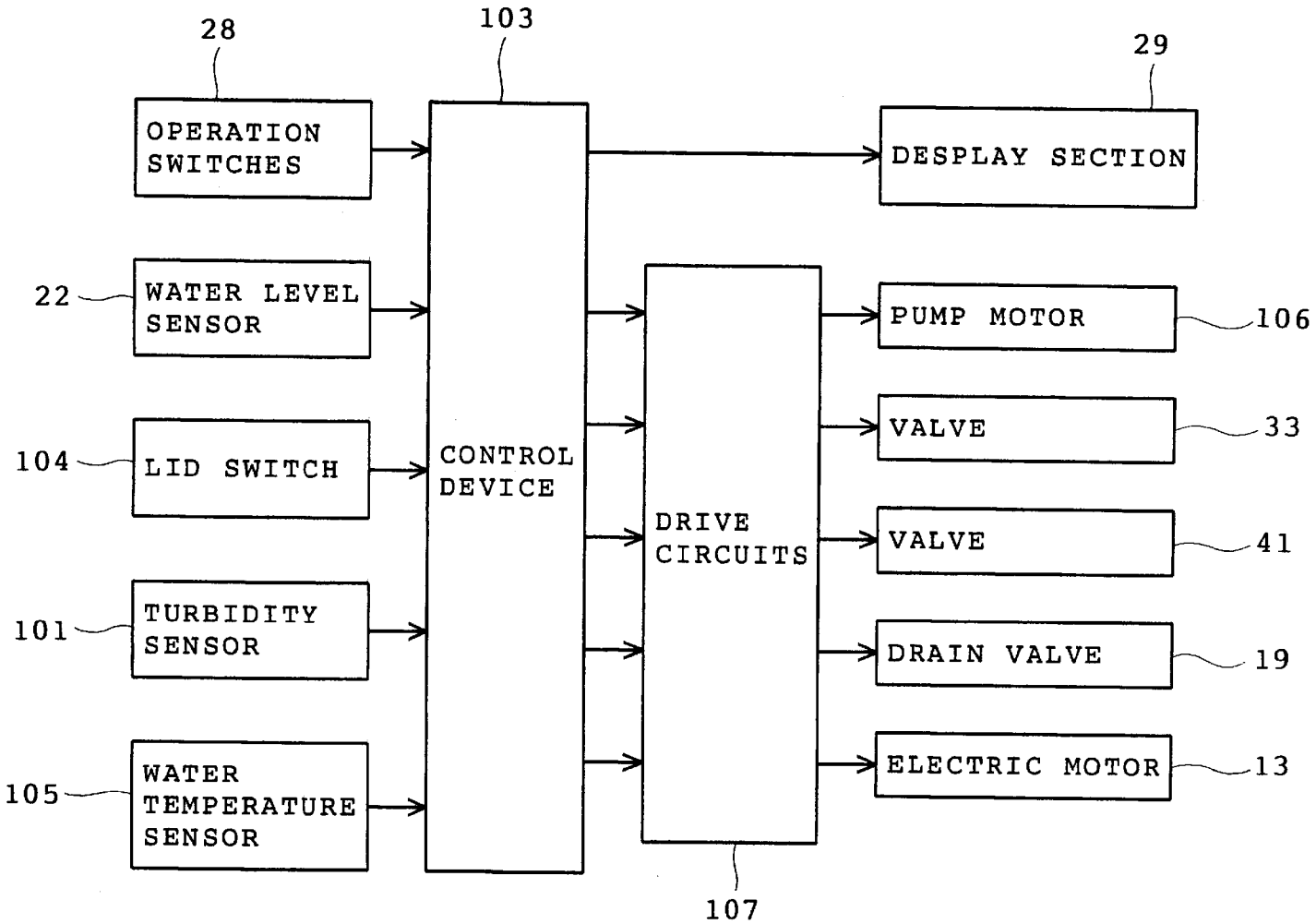
FIG. 5 is a schematic block diagram showing an electrical arrangement of the washing machine.

FIG. 5 illustrates an electrical arrangement of the washing machine. A control device serving as controlling means includes a microcomputer-based circuit and stores a control program for controlling the overall operation of the washing machine. The operation switches 28 and lid switch 104 generate respective operation signals. The water level sensor 22, turbidity sensor 101 and water temperature sensor 105 generate respective. detection signals. The operation signals and detection signals are delivered to the control device 103. The lid switch 104 generates the operation signal in response to the opening and closing of the lid 49. The water temperature sensor 105 generates a detection signal whose level is in accordance with a temperature of the wash liquid in the wash tub 6.

The display section 29 is electrically connected to the control device 103. Further, a pump motor 106 driving the pump 39, the valves 33 and 41, drain valve 19, and motor 13 are connected via drive circuitry 107 to the control device 103. The control device 103 controls the display section 29, pump motor 106, valves 33 and 41, drain valve 19 and motor 13, based on the detection signals from the sensors 22, 101 and 105, the operation signals from the switches 28 and 104 and the control program.

The operation switches 28 include a power supply switch, a switch for selecting a washing course, a start switch, a switch for selecting a tap water supply mode or a bathwater supply mode, and a switch for selecting an antimicrobial water supply mode or a normal water supply mode. In the tap water supply mode, tap water is supplied via the tap water supply path into the wash tub 6. In the bathwater supply mode, the pump 39 is driven to supply bathwater via the bathwater supply path into the wash tub 6. In the antimicrobial water supply mode, tap water or bathwater is supplied through the chamber, 35*a* (antimicrobial water supply path). More specifically, tap water or bathwater is supplied into the wash tub 6 via the pipe 34, water path 35*b*, chamber 35*a*, siphon chamber 35*g*, siphon pipe 37, water path 35*k* and pipe 36 sequentially. In the normal water supply mode, tap water or bathwater is supplied into the wash tub without passing through the chamber 35*a* (normal water supply mode). More specifically, tap water or bathwater is supplied into the wash tub 6 via the pipe 43, water path 35*k* and pipe 36 sequentially.

The operation of the washing machine will now be described with reference to FIGS. 6 to 9. In the following description, a standard washing course is carried out under the antimicrobial water supply mode. In the standard washing course, a wash step, first rinse step, intermediate dehydration step, second rinse step and final dehydration step are executed sequentially in this order. First, the setting of the tap water supply mode will be described. upon operation of the start switch, the wash step is initiated in which water supply is first carried out. In this case, the valve outlet of the first valve 33 at the pipe 38 side is open. As a result, tap water is caused to flow through the pipes 38 and 43 into the water path 35*k* of the water-supply case 35 and is then supplied through the normal water supply path leading to the pipe 36 and the outlet 31 into the wash tub 6 (water-receiving tub 4). A predetermined amount of washing detergent is supplied into the wash tub 6 with the tap water. the above-described water supply via the normal water supply path is carried out until the water level sensor 22 detects reach of a predetermined water level in the water-receiving tub 4. Upon completion of the water supply, the driving mechanism 17 is controlled so. that the agitator 8 is rotated repeatedly alternately in the normal and reverse directions. As a result, the water in the wash tub 6 is agitated together with the detergent and laundry. Upon expiration of a preset period of time, the agitation is completed and then, the drain valve 19 is opened so that the wash liquid is discharged from the wash and water-receiving tubs 6 and 4, whereupon the wash step is completed.

The first rinse step is then initiated and the water supply is carried out. In the water supply in the first rinse step, the valve outlet of the valve 33 at the pipe 38 side is opened for a predetermined initial time period and the valve outlet at the pipe 34 side is opened for a remaining time period. More specifically, tap water is supplied via the normal water supply path into the wash tub at an initial stage of water supply. When a predetermined amount of tap water is supplied into the wash tub 6, the valve 33 is switched so that the valve outlet at the pipe 34 side is opened. As a result, the tap water is caused to flow through the pipe 34 and water path 35*b* in the water-supply case 35 into the chamber 35*a*. The tap water having flown into the chamber 35*a* is received by the buffer member 48 and then flows downward along the surface of the antimicrobial agent 45 while spreading substantially on the overall surface of the antimicrobial agent. The tap water then flows through the inclined bottom 35*c* and hole 102*b* into the siphon chamber 35*g*. The tap water remains in the chamber 35*a* and siphon chamber 35*g* until the water level reaches the upper end of the siphon pipe 37. Thereafter, the tap water having flown out of the siphon pipe 37 by the siphonage is supplied through the water path 35*k*, pipe 36 and outlet 31 into the wash tub 6.

The tap water is supplied onto the surface of the antimicrobial agent 45. Further, the tap water is reserved in the chamber 35*a* such that the antimicrobial agent 45 is immersed in the tap water. Consequently, the antimicrobial agent 45 is hydrolyzed thereby to release hypochlorous acid. Accordingly, the tap water supplied via the aforesaid antimicrobial water supply path into the wash tub 6 contains the hypochlorous acid produced by the hydrolysis of the antimicrobial agent 45. Water supplied via the antimicrobial water supply path into the wash tub 6 will hereinafter be referred to as "antimicrobial water." Supply of the antimicrobial water is ended when a predetermined water level is reached in the wash tub 6.

Furthermore, in the first rinse step, the driving mechanism 17 is actuated to drive the agitator 8 until a predetermined water level is reached in the wash tub 6 by supply of the antimicrobial water or when about one half of the predetermined water level is reached in the wash tub 6. As a result, the normal tap water which has already been supplied into the wash tub 6 is mixed with the antimicrobial water such that highly enriched hypochlorous acid contained in the antimicrobial water is diluted. Further, since the agitation is initiated at an early stage of the first rinse step, the antimicrobial water efficiently penetrates laundry. Upon expiration of a predetermined time period, the agitation is completed and the drain valve 19 is opened. The water is discharged out of the tubs 6 and 4 and the first rinse step is finished. An execution time. period. of the first rinse step under the antimicrobial water supply mode is set to be longer than one of the first rinse step under a normal water supply mode as will be described later.

The antimicrobial water is thus supplied into the wash tub 6 in the first rinse step, whereas the normal tap water is supplied into the wash tub in the wash step. The reason for this water supply manner is as follows: A large amount of soil of the laundry and organic compound contained in the detergent is contained in the wash liquid in the wash step. Accordingly, a large quantity of hypochlorous acid is consumed for oxidation of organic compound and accordingly, a sufficient antimicrobial effect cannot be achieved from the antimicrobial water. On the other hand, since overall soil is almost removed from the laundry in the wash step and no detergent is used in the rinse step, a quantity of organic compound contained in the wash liquid is small in the rinse step. Consequently, a sufficient antimicrobial effect can be achieved from the antimicrobial agent 45.

Figure 7:
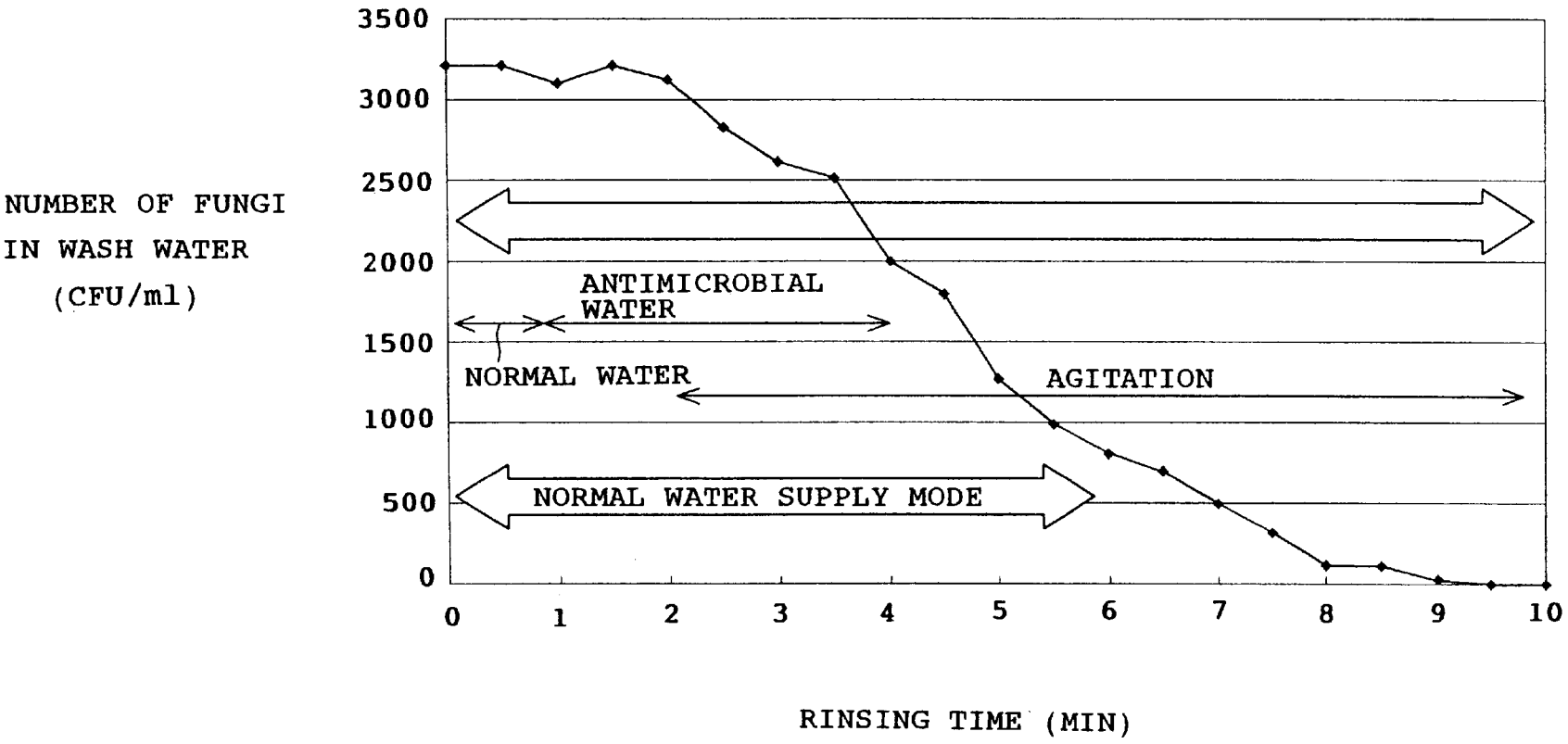
FIG. 7 is a graph showing changes in the number of fungi in the wash liquid under a first rinse step.

FIG. 7 illustrates the changes in the number of fungi contained in the wash liquid in the first rinse step under the antimicrobial water supply mode. The changes in the number of fungi were obtained from experiments and are shown by polygonal line in FIG. 7. In FIG. 7, void arrows denote an execution time period (6 minutes) of the first rinse step under the normal water supply mode and an execution time period (10 minutes) of the first rinse step under the antimicrobial water supply mode. Further, arrows in FIG. 7 denote the timing for execution of water supply by way of the normal water supply path in the first rinse step, the. timing for execution of water supply by way of the antimicrobial water supply path, and the timing for execution of the agitation respectively. More specifically, the normal tap water is supplied into the wash tub 6 for about one minute and thereafter, the antimicrobial water is supplied into the wash tub for about 3 minutes, whereupon the predetermined water level is reached in the wash tub 6. Agitation by the agitator 8 is initiated upon lapse of about one minute from start of antimicrobial water supply or upon lapse of about 2 minutes from start of water supply.

Generally speaking, the wash liquid contains several hundreds to several thousands (CFU/ml) of various fungi when the wash step has been finished. FIG. 7 shows the case where the wash liquid contains about 3200 CFU/ml of fungi. As obvious from FIG. 7, the number of fungi contained in the wash liquid is conspicuously reduced at the time when the agitation is initiated and afterwards. Almost all the fungi are disposed of when eight to ten minutes have passed from the start of the rinse step. On the other hand, several hundreds (CFU/ml) of fungi remain in the wash liquid when six minutes have passed from the start of the rinse step under the normal water supply mode. The remaining fungi propagate and produce an offensive smell when the laundry is left in a wet atmosphere. In view of this problem, the execution time period of the rinse step under the antimicrobial water supply mode is set to be longer than that of the rinse step under the normal water supply mode.

Upon finish of the first rinse step, the driving mechanism 17 is controlled so that the wash tub 6 and the agitator 8 are rotated, whereby the intermediate dehydration step is carried out. The second rinse step and the final dehydration step are carried out in turn upon finish of the intermediate dehydration step. In the second rinse step, tap water is supplied into the wash tub 6 via the same normal water supply mode as that in the above-described wash step. Thereafter, the agitator 8 is driven so that the agitation is carried out, whereupon the hypochlorous acid soaking in the laundry is removed. Further, the same operation is carried out in the final dehydration step as in the above-described intermediate dehydration step. Thereafter, the washing course is completed.

The bathwater mode will now be described. The differences between the tap water mode and the bathwater mode will mainly be described. Upon start of the water-supply in the wash step, the suction pump 39 is driven so that bathwater in a bath is pumped up through the suction hose. The valve outlet of the second valve 41 at the pipe 43 side is open at this time. Accordingly, the bathwater is supplied through the pipe 40, valve 41, pipe 43, water path 35*k* of the water-supply case 35, pipe 36 and outlet 31 into the wash tub 6. Upon finish of the aforesaid water supply, the agitation and dehydration are carried out in turn in the same manner as in the above-described tap water supply mode and thereafter, the wash step is finished.

The first rinse step is then initiated and water supply is carried out. The suction pump 39 is driven so that bathwater in the bath is pumped up through the suction hose. In this case, the valve outlet of the second valve 41 at the pipe 43 side is open for a predetermined time period at an initial stage of the water supply. The valve outlet of the valve 41 at the pipe 42 side is open for a remaining time period of the water supply. Accordingly, at. the initial stage of the water. supply, the bathwater is supplied into the wash tub 6 through the normal water supply path in the same manner as in the wash step. When a predetermined amount of bathwater is supplied into the wash tub 6, the valve 41 is switched so that the valve outlet of the valve 41 at the pipe 42 side is opened. As a result, the bathwater flows through the pipe 40, valve 41, and pipes 42 and 34 into the water-supply case 35. The bathwater further flows through the water path 35*b* into the chamber 35*a* in the same manner as in the tap water supply mode. The bathwater having flown into the chamber 35*a* is received by the buffer member 48 and then flows downward along the surface of the antimicrobial agent 45 while spreading substantially on the overall surface of the antimicrobial agent.

The bathwater remains in the chamber 35*a* and the siphon chamber 35*g* until the water level reaches the upper end of the siphon pipe 37. Thereafter, the bathwater having flown out of the siphon pipe 37 by the siphonage is supplied through the water path 35*k*, pipe 36 and outlet 31 into the wash tub 6. As a result, the bathwater containing hypochlorous acid or the antimicrobial water is supplied into the wash tub 6. Furthermore, in the first rinse step, the agitation by the agitator 8 is initiated before the predetermined water level is reached in the wash tub 6 after start of the supply of antimicrobial water. Consequently, the same effect can be achieved from the bathwater supply mode as from the tap water supply mode. In the second rinse step, the bathwater is supplied into the wash tub 6 through the same normal water supply path as in. the above-described wash step. Further, in each of the intermediate and final dehydration steps, the same operation is carried out as in the tap water supply mode. When the normal water supply mode is set, water is supplied without flowing through the chamber 35*a* in each of the tap water and bathwater supply modes.

According to the above-described embodiment, the antimicrobial water is supplied into the wash tub 6 in the first rinse step under each of the tap water and bathwater supply modes when the antimicrobial water supply mode is set. Consequently, the number of fungi contained in the wash liquid can be reduced by the antimicrobial action of the hypochlorous acid and accordingly, the number of fungi adherent to the laundry after the washing can be reduced. Further, since the antimicrobial water is supplied into the wash tub 6, the propagation of fungi can be limited on the outer circumferential face of the wash tub 6 and the inner circumferential face of the water-receiving tub 4.

In particular, the tap water or bathwater is supplied into the wash tub 6 through the normal water supply path without passing through the chamber 35*a* of the water-supply case 35 before the antimicrobial water is supplied into the wash tub. In other words, the antimicrobial water is supplied into the wash tub 6 after the laundry is soaked in the normal tap water or bathwater, whereupon the concentration of the hypochlorous acid is diluted. Consequently, the laundry can be prevented from being partially decolored or discolored by direct contact with the antimicrobial water containing hypochlorous acid in high concentration.

The antimicrobial agent 45 is formed into the shape of a tablet and has the chamfered corners A. Consequently, an, area of the solid antimicrobial agent 45 brought into contact with water can be increased, and the agent can be prevented from being easily collapsed when water is poured onto it. Further, the buffer 48 is attached to the upper face of the antimicrobial agent 45 so that water is poured onto the overall surface of the agent. Additionally, the force of the water poured onto the antimicrobial agent 45*i* is reduced by the buffer 48. Consequently, the antimicrobial agent 45 can be prevented from being partially dissolved or collapsed.

The filter 47 having fine meshes is attached to the outer peripheral face of the cassette case 44. Accordingly, if the antimicrobial agent 45 should collapse such that part of the agent flows out or should dissolve into a small size, the antimicrobial agent 45 is prevented from passing through the filter 47 in the solid state. Consequently, the antimicrobial agent 45 can be prevented from being discharged into the wash tub in the solid state and accordingly, the laundry can be prevented from decolored or discolored.

Figure 8:
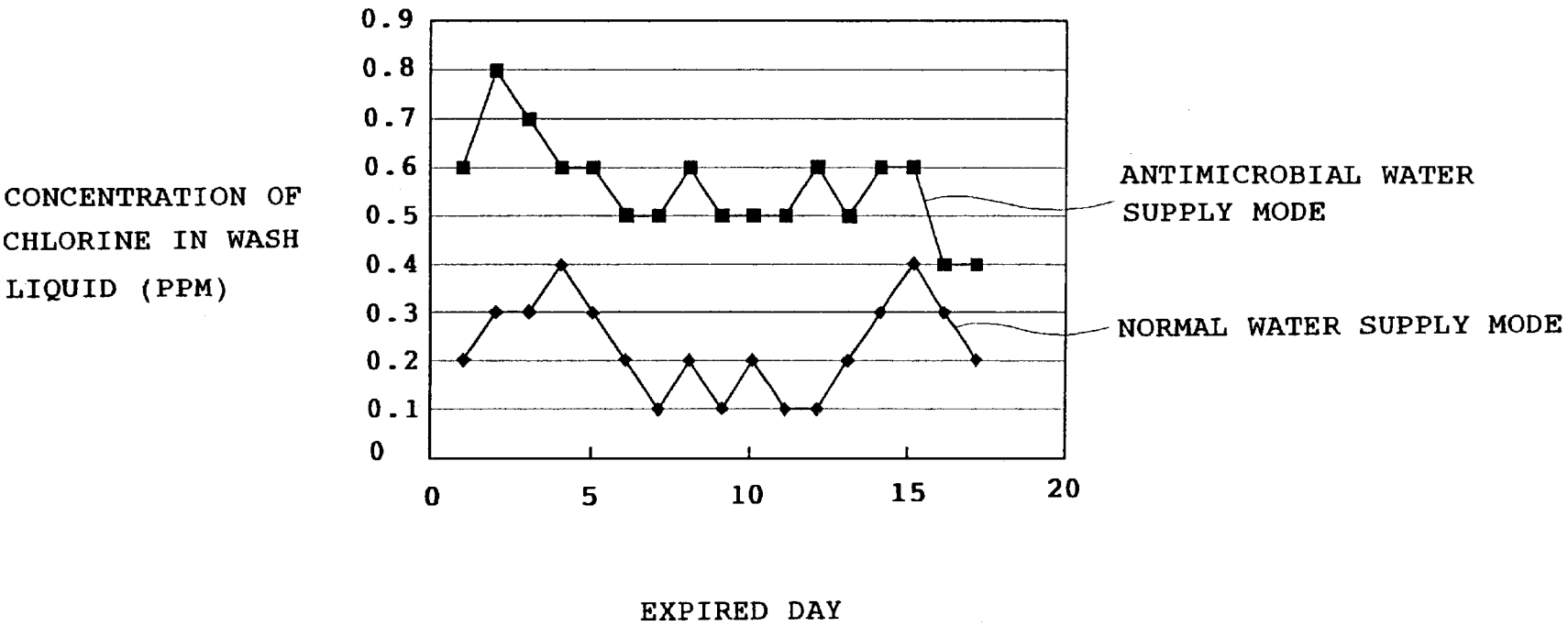
FIG. 8 is a graph showing changes in the concentration of chloride in the wash liquid as the service life of the antimicrobial agent.

FIG. 8 shows the service life of the antimicrobial agent 45 together with the changes in the concentration of chlorine (concentration of hypochlorous acid) contained in the wash liquid in the first rinse step when the standard washing course under the tap water supply mode is carried out once every day for 17 weeks. In the graph of FIG. 8, a polygon formed by square points denotes the changes in the concentration of chlorine under the antimicrobial water supply mode, whereas a polygon formed by rhombic points denote the changes in the concentration of chlorine under the normal water supply mode. In the normal water supply mode, the concentration of chlorine contained in the wash liquid changes in the range between 0.1 and 0.4 ppm throughout the weeks. However, in the antimicrobial water supply mode, the concentration of chlorine contained in the wash liquid changes in the range between 0.5 and 0.8 u ppm in the period from the first to fifteenth weeks. The concentration is decreased to 0.4 ppm in the sixteenth and seventeenth weeks. Accordingly, the antimicrobial agent 45 keeps releasing the hypochlorous acid for a long period of at least 15 weeks, for which period the antimicrobial action is effective.

Figures 9, 10:
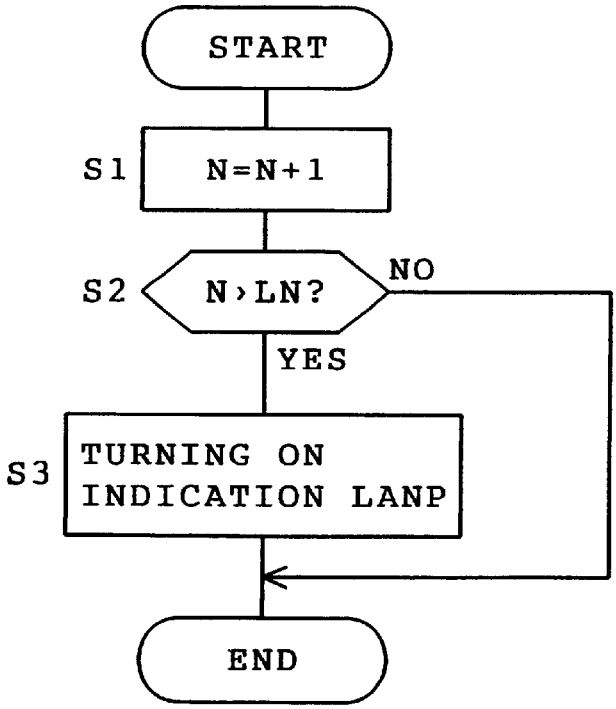
FIG. 9 shows the relationship between the concentration of hypochlorous acid and the antimicrobial effect.
FIG. 10 is a flowchart showing processing for turning on a lamp indicating supplement of antimicrobial agent in the washing machine of a second embodiment in accordance with the invention.

On the other hand, FIG. 9 shows the relationship between the concentration of hypochlorous acid and the antimicrobial effect (changes in the number of fungi). The relationship between the concentration of hypochlorous acid and the antimicrobial effect were experimentally examined regarding water containing the number of fungi approximately equal to that contained in normal wash liquid. FIG. 9 shows that the number of fungi can be reduced to or below several hundreds (CFU/ml) when the concentration of hypochlorous acid is at or above 0.1 ppm. In particular, when the concentration of hypochlorous acid is at or above 0.5 ppm, the number of fungi can be reduced to or below 100 (CFU/ml), whereupon effective antimicrobial action can be achieved.

Normal tap water usually contains about 0.4 ppm of hypochlorous acid. Accordingly, a dissolving speed of the antimicrobial agent 45 is adjusted so that the concentration of chlorine contained in water immediately after the water has been brought into contact with the antimicrobial agent 45 is increased in a range between 0.1 and 10 ppm when the water temperature is at about 25° C. Consequently, the antimicrobial water is diluted with tap water supplied through the normal water supply path such that the concentration of chlorine contained in the wash liquid can be adjusted to be at or above 0.5 ppm. Additionally, when a saturation solubility of the antimicrobial agent 45 at 25° C. ranges between 50 and 2000 ppm, the concentration of chlorine contained in the wash liquid can be ranged between 0.5 ppm at which effective antimicrobial effect can be achieved and several hundreds ppm at which odor produced by chlorine is not offensive.

FIG. 10 shows a second embodiment of the invention. The differences between the first and second embodiments will b e described. In the second embodiment, the control device 103 is provided with a counting function of counting the number of times of the washing operation executed under the antimicrobial water supply mode. When the counted number reaches a predetermined value, the control device 103 displays on the operation panel 27 an indication that the antimicrobial agent 45 should be replaced. In this regard, the operation panel 27 is provided with an indication lamp (not shown). The control device 103 turns on the indication lamp to inform that the antimicrobial agent 45 should be replaced. Thus, the control device 103 constitutes measuring means. The control device 103 and the indication lamp constitute informing means.

The process for counting the number of times of the washing operation will now be described with reference to FIG. 10. The processing starts when all the steps of the washing operation under the antimicrobial water supply mode has been completed. More specifically, the number N of times of the washing operation is incremented by 1 at step S1. Data of the number N is stored on a rewritable non-volatile memory, for example. At step S2, the number N is compared with a preset limit number LN. When the number N is larger than the limit number LN (YES at step S2), the control device 103 advances to step S3 to turn on the indication lamp and thereafter finishes the processing. In this case, when the user replaces the antimicrobial agent 45 by a new one, the indication lamp is turned off and the number N is reset at 0. On the other hand, when the number N is smaller than the limit number LN (NO at step S2), the control device 103 finishes the processing.

According to the second embodiment, the time for redisposition of the antimicrobial agent 45 can reliably be informed of. As a result,the washing operation can be prevented from being carried out under the antimicrobial water supply mode. Instead of turning on the lamp, a buzzer may be actuated or the display section 29 may display a message indicating that the antimicrobial agent 45 should be replaced. Further, the display section 29 may display the number N, whereupon the user can expect the time for redisposition of the antimicrobial agent. Additionally, the control device 103 may count the number of times of contact of tap water and bathwater with the antimicrobial agent 45 or the number of times at which the valve outlet of the valve 33 at the pipe 34 side and the valve outlet of the valve 41 at the pipe 42 side are opened, instead of counting the number of times of the washing operation under the antimicrobial water supply mode.

Figure 11:
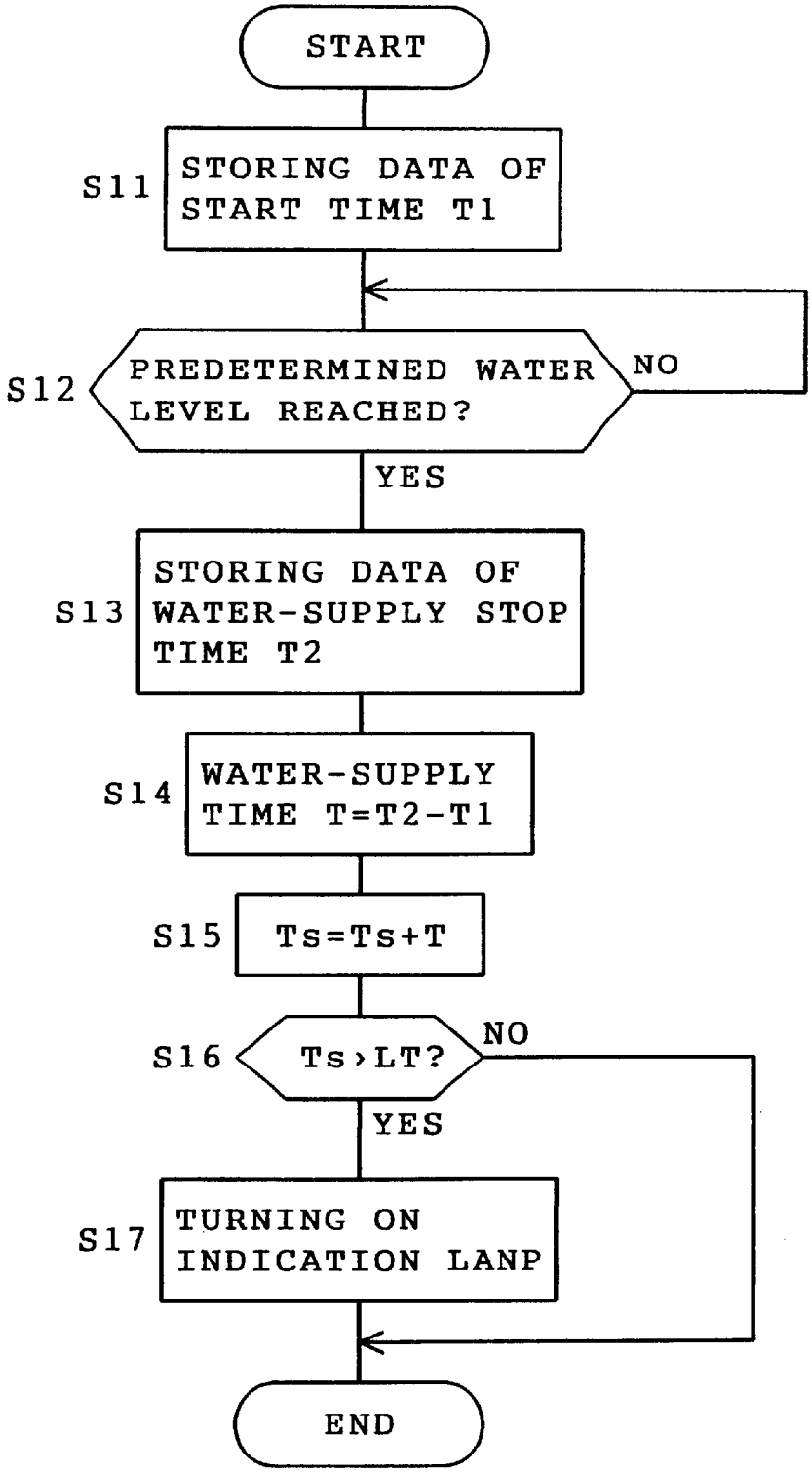
FIG. 11 is a flowchart showing processing for turning on a lamp indicating supplement of antimicrobial agent in the washing machine of a third embodiment in accordance with the invention.
Figure 12:
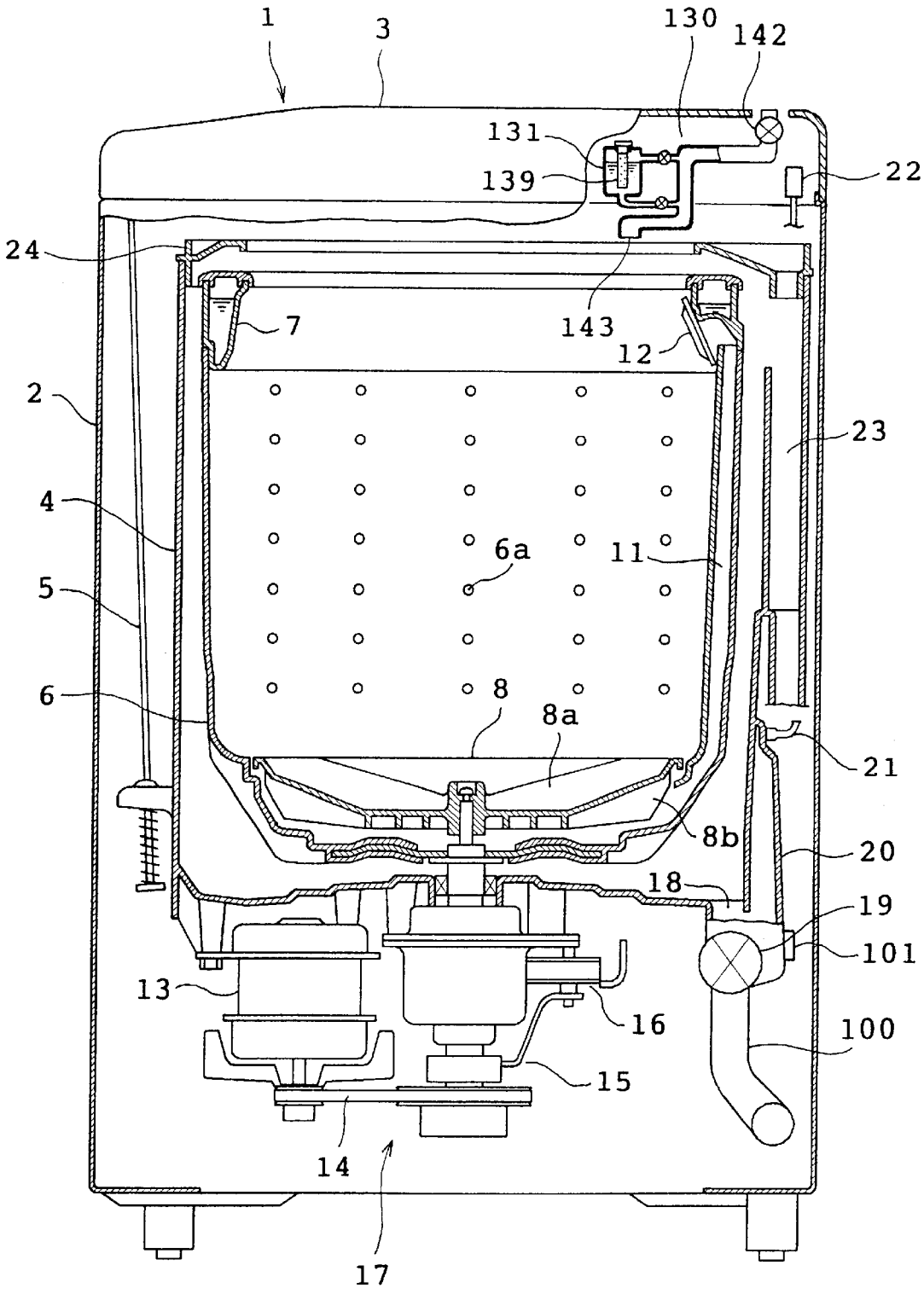
FIG. 12 is a view similar to FIG. 2, showing the washing machine of a fourth embodiment in accordance with the invention.

FIG. 11 illustrates a third embodiment of the invention. Only the differences between the second and third embodiments will be described. In the third embodiment, the control device 103 has a function of measuring a time period for supply of antimicrobial water through the antimicrobial water supply path. The control device 103 turns on the indication lamp when an accumulated time for supply of antimicrobial water reaches a predetermined limit time. Thus, the control device 103 constitutes timing means.

FIG. 11 shows a process for measuring the antimicrobial agent. The process starts when the water supply through the antimicrobial water supply path is initiated. Data of a start time T1 of the water-supply operation is first stored at step S11. At step S12, whether the predetermined water level is reached in the wash tub 6 is determined. When the predetermined water level is set and the water supply is finished (YES), the control device 103 advances to step S17 to turn on the indication lamp and finishes measurement of the water supply time period. In this case, when the antimicrobial agent 45 is supplemented by the user, the indication lamp is turned off and the accumulated water supply time period Ts is reset to 0 as an initial value. On the other hand, when the limit time LT is larger than the accumulated water supply time period Ts (NO at step S16), the measuring process is finished. Since the other construction in the third embodiment is the same as that in the second embodiment, the same effect can be achieved from the third embodiment as from the second embodiment.

FIGS. 12 to 15 illustrate a fourth embodiment. Only the differences between the first and fourth embodiments will be described. In the fourth embodiment, a water supply mechanism 130 is provided on the top cover 3 in the rear interior of the top cover 3 instead of the water-supply mechanism 30. The water supply mechanism 130 includes a water reservoir 131, a main path 130*a*, and auxiliary paths 130*b* and 130*c* connecting the reservoir to the main path. The reservoir 131 has a water inlet 132 formed through an upper side wall thereof. The auxiliary path 130*b* is connected to the inlet 132. The reservoir 131 further has a water outlet 133 formed through a central portion of the bottom thereof. The auxiliary path 130*b* is connected to the outlet 133. The reservoir 131 further has an access opening 134 formed through a central top thereof. A packing 135 is attached to a peripheral edge of the access opening 134. The top of the reservoir 131 further has a plurality of air vents 136 formed around the access opening 134.

An antimicrobial stick 139 is drawably inserted through the access opening 134 into the reservoir 131. The stick 139 includes an antimicrobial agent 137 pressed into the shape of ba square column and a knob 138 provided on an upper portion of the antimicrobial agent. The knob 138 includes a head 138*a* formed on an upper portion thereof and has a larger section than the access opening 134. When the stick 139 is inserted through the opening 134, the head 138*a* is supported via the packing 135 on the top of the reservoir 131. Thus, the reservoir 131 serves as the disposition. section.

The solid antimicrobial agent 137 is made by dispersing a brominated isocyanuric compound into a. water soluble high molecular compound and solidifying the mixture by means of pressing. The brominated isocyanuric compound. releases hypochlorous acid at a higher speed than the above-described halogenated hydantoine. In view of this, the brominated isocyanuric compound is dispersed into the high molecular compound so that the speed at which the hypochlorous acid is released is reduced. Consequently, the antimicrobial agent 137 gradually releases the hypochlorous acid when brought into contact with water.

Figure 15:
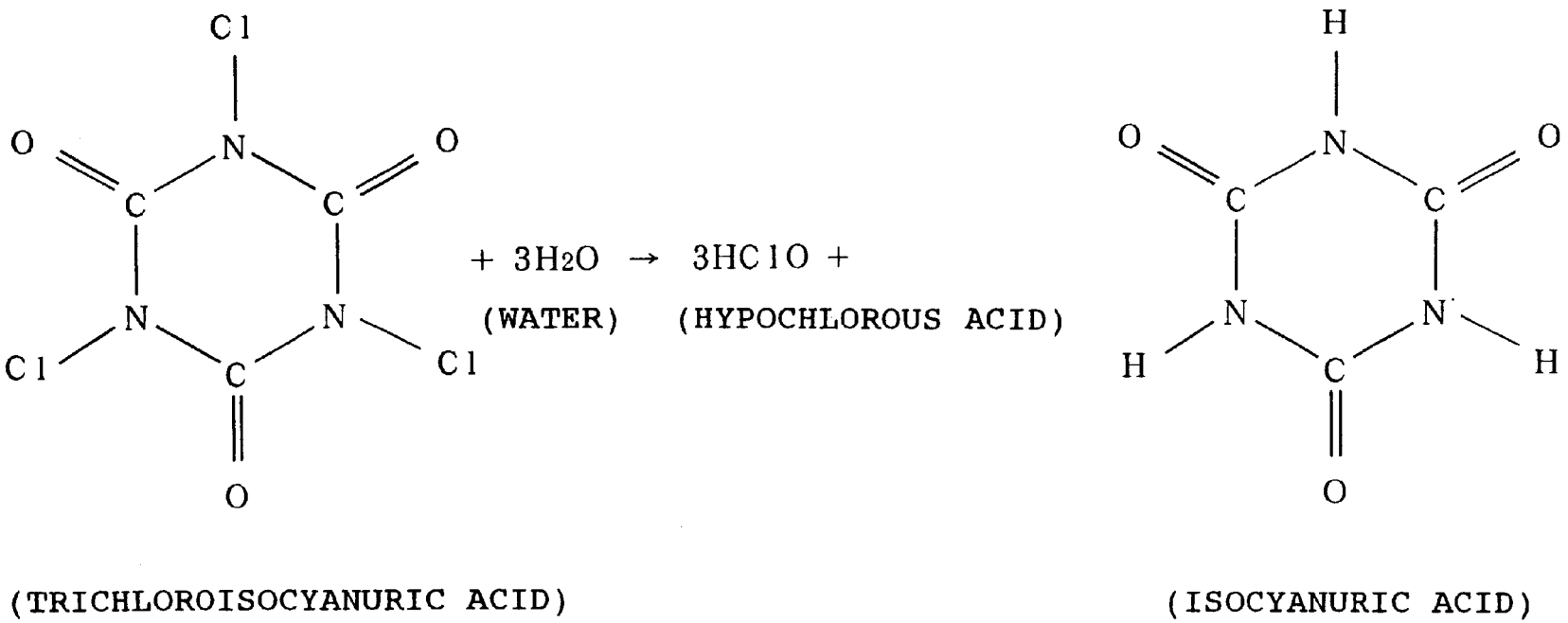
FIG. 15 shows hydrolysis of trichloroisocyanuric acid.

The brominated isocyanuric compound includes trichloroisocyanuric acid, dichloroisocyanuric acid sodium, and dichloroisocyanuric acid potassium. The water soluble high molecular compound includes polyethylene glycol, polyacrylic sodium, a copolymer of polyacrylic sodium and maleic acid, a copolymer of polyacrylic sodium and monomer of sulfonic acid system, polyvinyl alcohol, and carboxymethyl cellulose. In the embodiment, the antimicrobial agent 137 comprises trichloroisocyanuric acid. FIG. 15 shows hydrolysis of trichloroisocyanuric acid.

Figure 13:
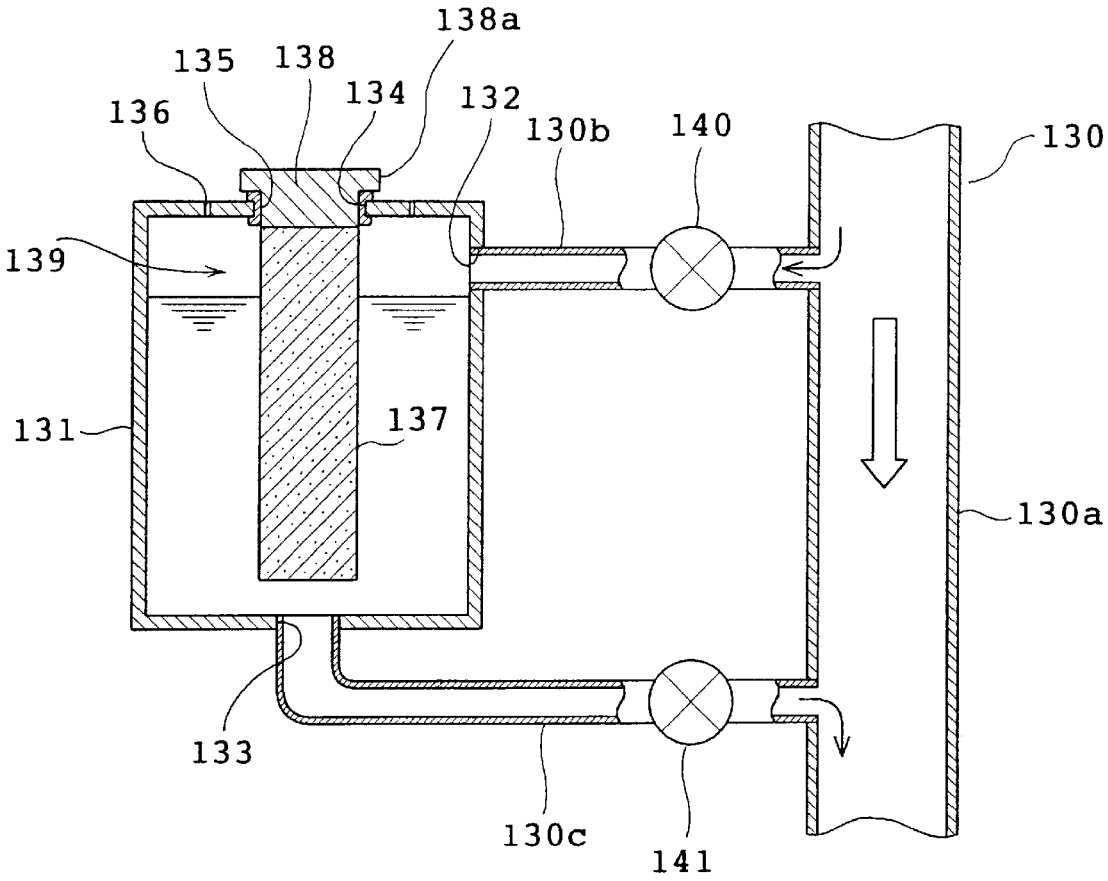
FIG. 13 is a longitudinal section of the water-supply mechanism.
Figure 14:
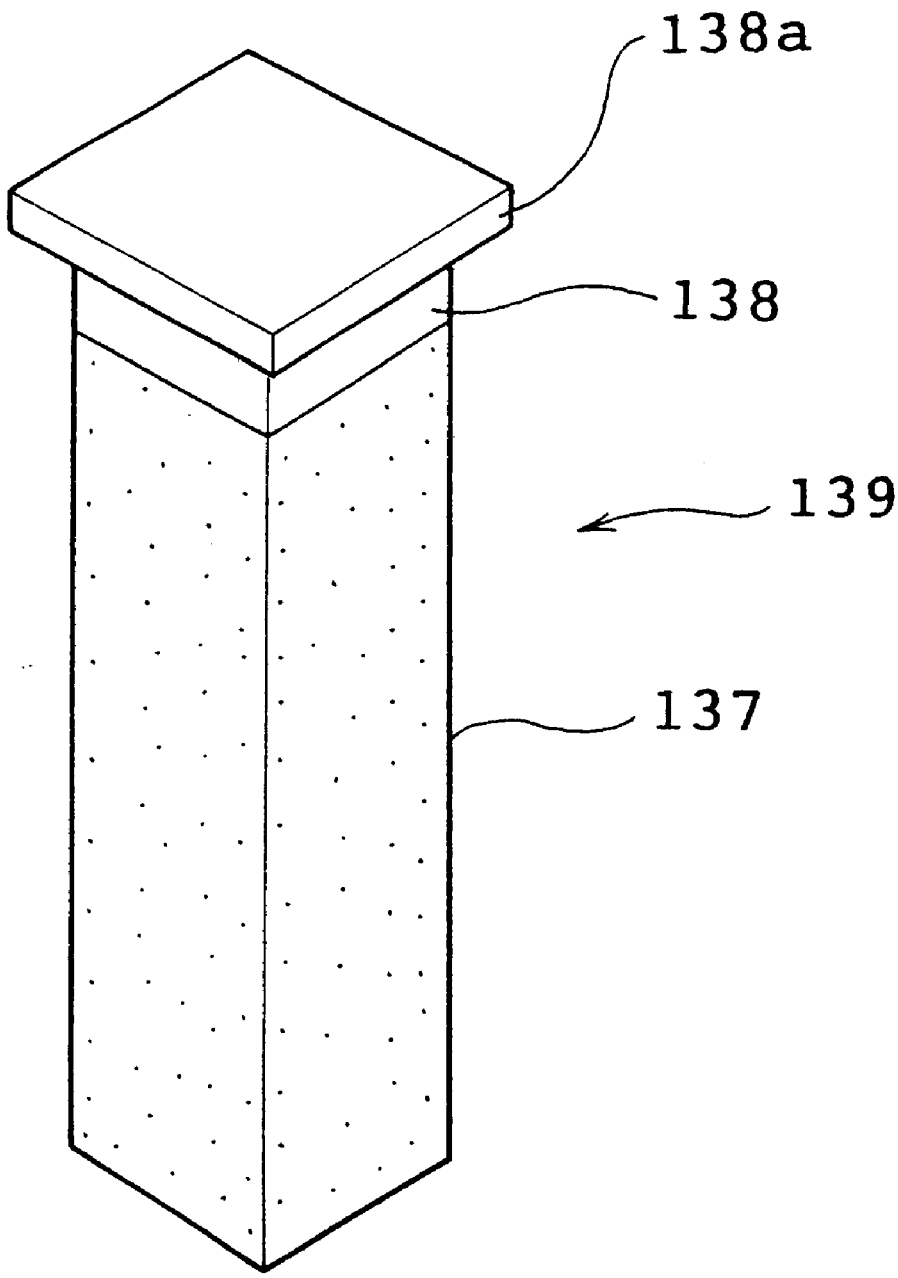
FIG. 14 is a perspective view of an antimicrobial stick.

The auxiliary paths 130*b* and 130*c* are provided with valves 140 and 141 in their middle portions respectively as shown in FIG. 13. An upper end of the main path 130*a* is connected to a water-supply valve 142 for tap water. The main path 130*a* has an outlet 143 in a lower end thereof. Accordingly, the tap water supply path comprises the main path 130*a*, auxiliary path 130*b*, reservoir 131, and auxiliary path 130*c*. Further, the main path 130*a* serves as. the normal water supply path. A path from the main path 130*a* through the auxiliary path 130*b*, reservoir 131 and auxiliary path 130*c* to the main path 130*b* serves as the antimicrobial water supply path. The washing machine of the embodiment is not provided with a suction pump for supplying bathwater into the wash tub 6. Accordingly, the water-supply mechanism 130 is provided with no bathwater supply path.

When the antimicrobial water supply mode is set and the standard washing course is then initiated, the wash step, first rinse step, intermediate dehydration step, second rinse step and final dehydration step are carried out sequentially. The valves 142 and 140 are opened when water is supplied into the wash tub in the wash step. The valve 141 is closed. As a result, part of tap water flowing through the main path 130*a* is supplied via the auxiliary path 130*b* into the reservoir 131. The valve 140 is controlled so as to remain open until the water level reaches a lower portion of the inlet 132. As a result, a sufficient amount of tap water is reserved in the reservoir 131 such that the antimicrobial agent 137 is immersed in the tap water, so that the antimicrobial agent releases hypochlorous acid. Thereafter, when the predetermined water level is reached in the wash tub 6, the water-supply valve 142 is closed and the water supply is finished. The agitation and dehydration are then carried out in turn.

Upon start of the first rinse step after the wash step, the valves 142 and 141 are opened. As a result, tap water is supplied through the main path 130*a* into the wash tub 6. Further, the tap water containing hypochlorous acid in the reservoir 131 or the antimicrobial water is also supplied through the auxiliary path 130*c* and main path 130*a* into the wash tub 6. When the predetermined water level is reached in the wash tub 6, the valves 142 and 141 are closed so that the water supply is finished. Thereafter, the agitation and dehydration are carried out in turn. In the embodiment, too, the dissolving speed of the antimicrobial agent 137, the mixture ratio of the antimicrobial water and normal tap water, etc. are adjusted so that the concentration of chlorine contained in the wash liquid is at or above 0.5 ppm at which value sufficient antimicrobial effect is achieved.

Upon finish of the first rinse step, the intermediate dehydration step, second rinse step and final dehydration step are carried out sequentially. Regarding the water supply in the second rinse step, the water-supply valve 142 is opened so that only the tap water is supplied into the wash tub 6 in the same manner as in the first embodiment. The other construction of the washing machine of the fourth embodiment is the same as in the first embodiment. Consequently, the same effect can be achieved from the fourth embodiment as from the first embodiment. Further, in the fourth embodiment, the tap water is reserved in the reservoir 131 during the water-supply operation in the wash step. Consequently, the antimicrobial water can be produced before the water-supply operation in the first rinse step is initiated. Further, since the antimicrobial agent 137 is made by dispersing trichloroisocyanuric acid into the water soluble high molecular compound, the antimicrobial effect of the agent 137 can be maintained for a long period of time. Additionally, the water soluble high molecular compound adheres to fiber of the laundry or particles of stain, preventing cohesion with each other. Accordingly, re-contamination of laundry can be prevented by the use of the antimicrobial agent 137 and the cleaning effect can be improved.

Figure 16:
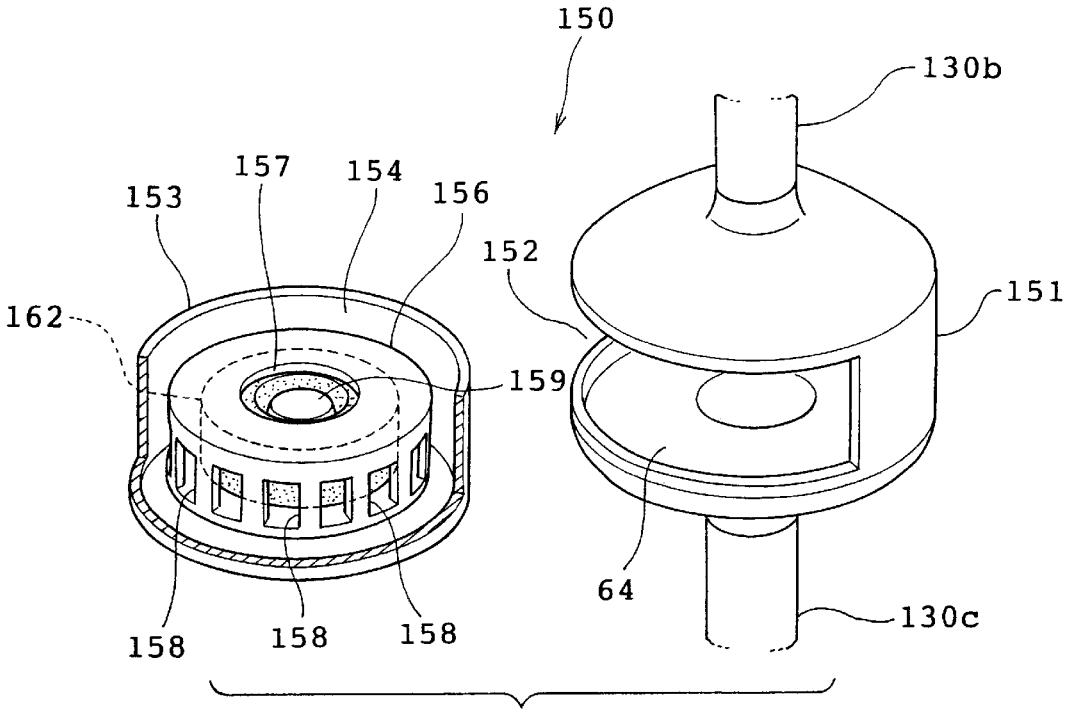
FIG. 16 is an exploded perspective view of an antimicrobial water producing device employed in the washing machine of a fifth embodiment in accordance with the invention.
Figure 17:
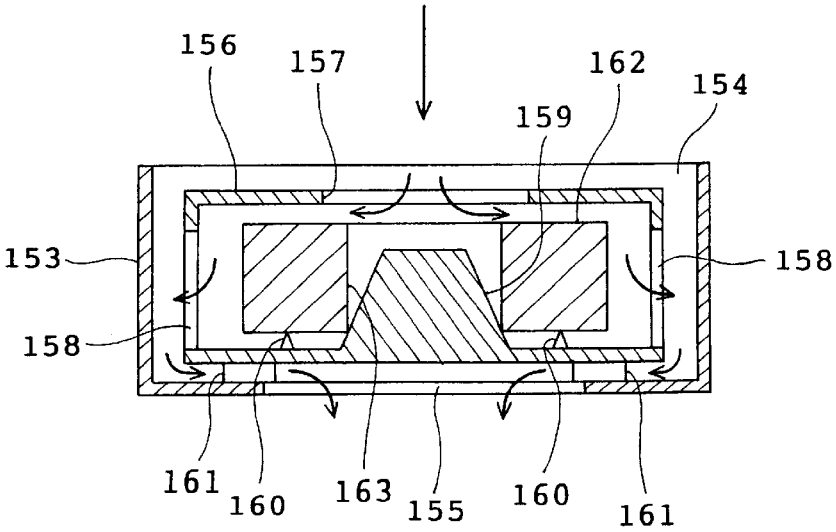
FIG. 17 is a longitudinal section of a water-supply vessel in which a cassette case is enclosed.

FIGS. 16 and 17 illustrate a fifth embodiment. Only the differences between the fourth and fifth embodiments will be described. In the fifth embodiment, an antimicrobial water producing device 150 is provided between the auxiliary paths 130*b* and 130*c*, instead of the reservoir 131. The antimicrobial water producing device 150 comprises a vessel mount 151, water-supply vessel 153 and cassette case 156. The auxiliary path 130*c* is not provided with the valve 141 in the fifth embodiment. The vessel mount 151 is formed into a flat cylindrical shape and has an upper face to which the auxiliary path 130*b* is connected and an underside to which the auxiliary path 130*c* is connected. A circumferential wall of the vessel mount 151 has an open section 152 occupying about one half thereof. The water-supply vessel 153 is inserted through the open section 152 to be detachably attached to the vessel mount 151. The vessel 153 is formed into a flat cylindrical shape and has an opening 154 in an upper face thereof and water outlet 155 in the central bottom thereof. A flat cylindrical cassette case 156 is accommodated in the water-supply vessel 153 and has a smaller diameter than the vessel. The cassette case 156 has a central inlet 157 formed in the top thereof. The cassette case 156 has a number of outlets 158 formed in the circumferential wall thereof. Further, a large protrusion 159 having the shape of a truncated cone is formed on the central bottom of the cassette case 156. A plurality of small protrusions 160 are formed around the large protrusion 159 on the bottom of the cassette case 159. The cassette case 159 further has a plurality of legs 161 formed on the backside thereof.

An annular antimicrobial agent 162 is enclosed in the cassette case 156. The antimicrobial agent 162 has the same composition as the afore said agent 137. The antimicrobial agent 162 has a central hole 163 which is loosely fitted with the large protrusion 159. The backside of the antimicrobial agent 162 is placed on the small protrusions 156. The outer circumferential face of the antimicrobial agent 162 is spaced from the inner circumferential face of the cassette case 156. Thus, the antimicrobial agent 162 is attached via the cassette case 156 and the vessel 153 to the vessel mount 151.

Only the water-supply valve 142 is opened in the water supply operation of the wash step so that the tap water is supplied through the main path 130*a* into the wash tub 6. On the other hand, in the water supply operation of the first rinse step, the valves 142 and 140 are opened so that the tap water is supplied through the main path 130*a* into the wash tub 6 and so that part of the tap water flows through the auxiliary path 130*b* into the vessel 153 attached to the vessel mount 151. The tap water flows from the vessel 153 through the inlet 157 into the cassette case 156 as shown by arrows in FIG. 17, further flowing downward along the surface of the antimicrobial agent 162. The tap water further flows through the outlet 158 into the vessel 153. When brought into contact with the tap water, the antimicrobial agent 162 gradually releases hypochlorous acid. Accordingly, water containing the hypochlorous acid or antimicrobial water flows into the water-supply vessel 153. The antimicrobial water is supplied from the vessel 153 through the outlet 158, auxiliary path 130*c* and main path 130*a* into the wash tub 6.

The other construction of the washing machine of the fifth embodiment is the same as in the fourth embodiment. Consequently, the same effect can be achieved from the fifth embodiment as from the fourth embodiment. Further, since the antimicrobial agent 162 is enclosed in the cassette case 156, the user need not directly touch the agent when the latter is set in the vessel 153. If the user should touch the antimicrobial agent 162 with his wet hand, the hand would smell bad due to the hypochlorous acid. However, this inconvenience can be solved in the fifth embodiment.

Experiments conducted by the inventors show that when trichloroisocyanuric acid is mixed with polyethylene glycol resin with molecular weight of 2 hundred thousands at a ratio of 1:3, the antimicrobial agent 162 has substantially the same life as the antimicrobial agent 45 in the first embodiment, whereupon the antimicrobial agent 162 releases the hypochlorous acid for a long period of time.

Figure 18:
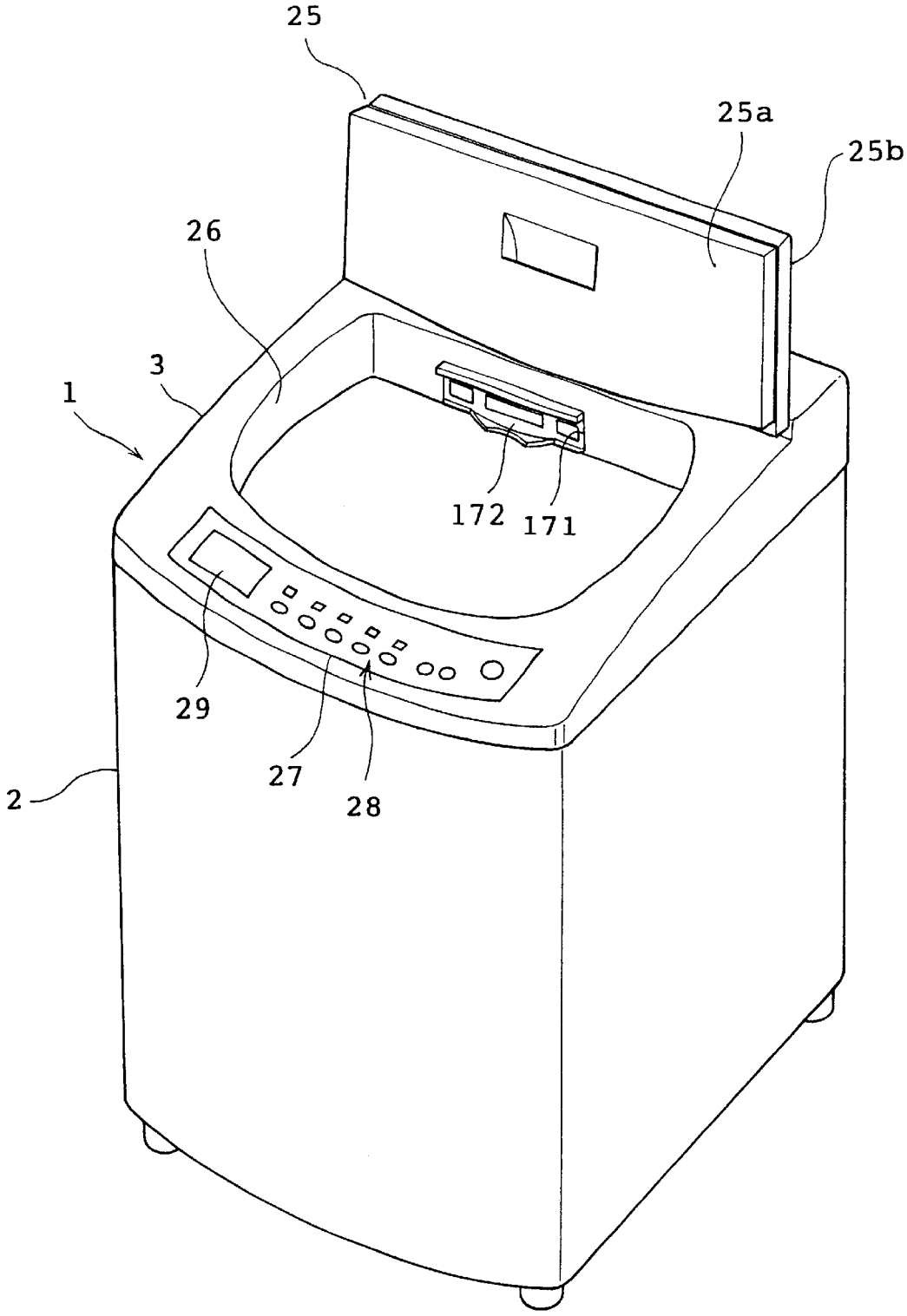
FIG. 18 is a view similar to FIG. 3, showing the washing machine of a sixth embodiment in accordance with the washing machine.
Figure 19:
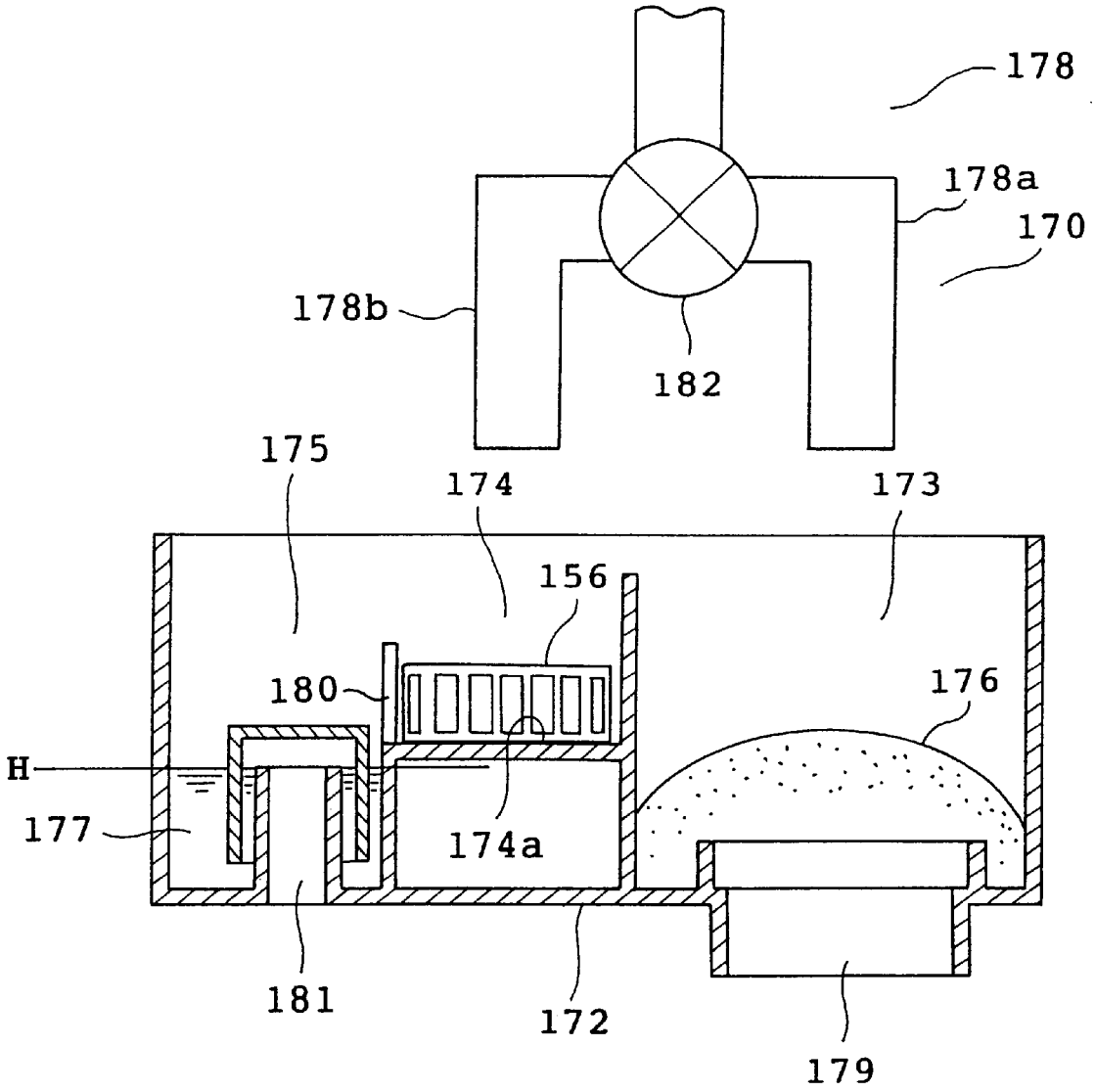
FIG. 19 is a longitudinal section of the water-supply mechanism.

FIGS. 18 and 19 illustrate a sixth embodiment. Only the differences between the first and sixth embodiments will be described. In the sixth embodiment, a water-supply mechanism 170 is provided in the rear interior of the top cover 3, instead of the. water-supply mechanism 30. The water-supply mechanism 170 includes a water-supply path 178 and a pouring case 172. The pouring case 172 is drawably accommodated. in a pouring section 171 provided in the rear of the circumferential edge of the access opening 26. The pouring case 172 has an open top and is provided with a detergent accommodating section 173, an antimicrobial agent accommodating section 174 and a softening agent accommodating section 175 therein. A powdered detergent 176 is accommodated in the detergent accommodating section 173. The aforesaid cassette case 156 is accommodated in the antimicrobial agent accommodating section 174. The solid antimicrobial agent 162 is accommodated in the cassette case 156 although this is not shown in the drawings. A liquid softening agent 177 is accommodated in the softening agent accommodating section 175. Accordingly, the antimicrobial agent accommodating section 174 serves as the disposition section, and the disposition section is provided in the pouring section 171.

The detergent accommodating section 173 has an water outlet 179 formed in the front bottom thereof. A communiting hole 180 is provided between the sections 174 and 175. A siphon pipe 181 is provided on the bottom of the softening agent accommodating section 175. The siphon pipe 181 is disposed so that the bottom of the section 174 is located higher than a position H of an upper end of the siphon pipe 181.

On the other hand, the water supply path 178 has an upper end connected to a water supply valve (not shown) for tap water. The water supply path 178 further has a lower end which is bifurcated to a detergent path 178*a* and an antimicrobial agent path 178*b*. A three-way valve 182 is provided in a bifurcation. The detergent path 178*a* is open over the detergent accommodating section 173. The valve 182 is switched between a mode in which water. is supplied through the detergent. accommodating section 173 into the wash, tub 6 and a mode in which water is supplied through antimicrobial agent accommodating section 174 into the wash tub 6. Accordingly, in the embodiment, the normal water supply path comprises the detergent path 178*a* and the detergent accommodating section 173. The antimicrobial water supply path comprises the antimicrobial agent path 178*b*, antimicrobial agent accommodating section 174 and softening agent accommodating section 175.

The outlet of the valve 182 at the detergent path 178*a* side is open during the water supply operation of the wash step. As a result, tap water passes through the detergent accommodating section 173, supplied into the wash tub 6 together with the detergent 176. Further, the outlet of the valve 182 at the antimicrobial agent path 178*b* side is open during the water supply operation at the first rinse step. Consequently, tap water flows through the detergent accommodating section 173 to be supplied into the wash tub 6 with the detergent 176.

Further, the outlet of the valve 182 at the antimicrobial agent path 178*b* side is opened during the water supply operation of the first rinse step. Consequently, tap water flows through the antimicrobial agent accommodating section 174, softening agent accommodating section 175 to be supplied into the wash tub 6 with the softening agent 177. In this case, since the tap water flows through the antimicrobial agent accommodating section 174, the antimicrobial agent 162 releases hypochlorous acid. Accordingly, the tap water supplied into the wash tub 6 contains hypochlorous acid.

The pouring case 172 is utilized as the disposition section for the antimicrobial agent 162 in the embodiment. This construction is simpler than the case where the disposition section of the antimicrobial agent 162 is provided in the middle of the water supply path. Further, the bottom 174*a* of the antimicrobial agent accommodating section 174 is located higher than the upper end of the siphon pipe 181. Accordingly, since the softening agent 177 is prevented from adhering to the surface of the antimicrobial agent 162, deterioration of the latter can be avoided.

The bathwater usually has a lower concentration of chlorine than the tap water. Further, the bathwater contains a large quantity of organic substance. In view of these facts, the concentration of chlorine contained in the wash liquid may be higher in the bathwater supply mode than in the tap water supply mode. Further, although the bathwater is supplied in both of the first and second rinse steps under the bathwater supply mode in the foregoing embodiments, tap water may be supplied in the second rinse step. Consequently, sanitary effect can be achieved as well as cleaning effect.

The accommodation chamber 35*a* may be closed by the lid 49 substantially tightly. Consequently, odor of chlorine can be prevented from leaking out of the chamber 35*a*. Further, a filter 41 may be provided downstream with respect to the disposition section of the antimicrobial agent in each of the third to fifth embodiments. Further, the concentration of hypohalogenous acid contained in the wash liquid may be adjusted. according to the result of detection by the turbidity sensor 101. In. this case, the mixing ratio of the antimicrobial water and normal water may be adjusted or the time period of contact between the antimicrobial agent and the water may be adjusted so that the concentration of the hypohalogenous acid contained in the wash liquid is adjusted.

An amount of hypohalogeous acid released from the antimicrobial agent differs depending upon the water temperature. Accordingly, a water temperature sensor may be provided for detecting the temperature of the water supplied into the disposition section of the antimicrobial agent, so that the mixing ratio of the antimicrobial water and normal water is adjusted or the contact time of the antimicrobial agent with the water is adjusted. Consequently, the concentration of hypohalogenous acid in the wash liquid can be adjusted so that effective antimicrobial action is obtained regardless of the water temperature.

As a method of adjusting the time of contact between the antimicrobial agent and water, a time period for which water is reserved in the reservoir 131 is adjusted as shown in the fourth embodiment. More specifically, the timing for opening the valve 140 in the water supply period in the wash step may be adjusted, or the timing for opening the valve 141 in the first rinse step may be adjusted. Further, the water level in the reservoir 131 may be adjusted so that the concentration of hypochlorous acid contained in the antimicrobial agent is adjusted.

The antimicrobial agent may contain a rust-preventive component when components of the washing machine body comprises those of the iron system. Consequently, the components of the iron system can be prevented from rust by the strong oxidyizing force of the hypohalogenous acid released as the result of contact of the antimicrobial agent with water. Additionally, the antimicrobial agent may composed of an organic compound having a plurality of types of nitrogen-halogen atom combinations.

A showering rinse step may be carried out between the wash step and the first rinse step. In the showering rinse step, laundry is dehydrated while tap water or bath water both containing no detergent nor no hypohalogenous acid is being supplied into the wash tub. Consequently, the antimicrobial effect of the hypohalogenous acid can be improved since the detergent remaining in the laundry can be eliminated.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A washing machine comprising:

a wash tub;

a water-supply mechanism for supplying water into the wash tub; and a disposition section in which a solid antimicrobial agent containing an organic compound having a nitrogen-halogen atomic combination is disposed, the disposition section being provided in the water-supply mechanism, the antimicrobial agent being brought into contact with water thereby to release hypohalogenous acid into the water.

2. The washing machine according to claim 1, wherein the organic compound comprises one or a mixture of a brominated hydantoine compound, a chlorinated hydantoine compound, and an iodinated hydantoine compound.

3. The washing machine according to claim 1, wherein the organic compound comprises a brominated isocyanuric compound.

4. The washing machine according to claim 1, wherein the water-supply mechanism includes a water-supply path for supplying the water from a water source to the wash tub, and the disposition section is provided in the midst of the water-supply path, and the washing machine further comprising a filter provided downstream with respect to a portion of the water-supply path on which the disposition section is provided.

5. The washing machine according to claim 1, wherein the water-supply mechanism includes a water-supply path for supplying the water from a water source to the wash tub, and the water-supply path includes an antimicrobial water supply path provided with the disposition section and a normal water supply path provided with no disposition section.

6. The washing machine according to claim 5, further comprising a control device selectively executing an antimicrobial water supply mode in which water having passed through the antimicrobial water path is supplied into the wash tub in a wash or rinse step and a normal water supply mode in which water having passed through the normal water path in the wash or rinse step, wherein the control device carries out the wash step or rinse step under the antimicrobial water supply mode for a longer time than under the normal water supply mode.

7. The washing machine according to claim 6, wherein the control device supplies into the wash tub the water having passed through the normal water supply path and thereafter supplies into the wash tub the water having passed through the antimicrobial water supply path under the antimicrobial water supply mode.

8. The washing machine according to claim 5, further comprising a measuring element measuring a number of times of an antimicrobial water supply operation in which the water is supplied through the antimicrobial water supply path into the wash tub and an informing element informing that the number of times of the antimicrobial water supply operation measured by the measuring element has reached a limit number of times.

9. The washing machine according to claim 5, further comprising a timing element measuring a time of an executed antimicrobial water supply operation in which the water is supplied through the antimicrobial water supply path into the wash tub and an informing element informing that the time measured by the timing element has reached a limit time.

10. The washing machine according to claim 5, further comprising a control device sequentially executing a wash step in which the water having passed through the normal water supply path is supplied into the wash tub so that a wash operation is carried out, a first rinse step in which the water having passed through the antimicrobial water supply path is supplied into the wash tub so that a rinse operation is carried out, and a second rinse step in which the water having passed through the normal water supply path is supplied into the wash tub so that a rinse operation is carried out.

11. The washing machine according to claim 5, further comprising a control device sequentially executing a first step in which the water having passed through the normal water supply path is supplied into the wash tub so that a wash operation is carried out, a second step in which a dehydration operation is carried out while the water having passed through the normal water supply path is supplied into the wash tub, and a third step in which the water having passed through the antimicrobial water-supply path is supplied into the wash tub so that a rinse operation is carried out.

12. The washing machine according to claim 1, wherein the water-supply mechanism includes a bathwater supply path provided for supplying bathwater into the wash tub, wherein the disposition section is provided in a midst of the bath water supply path.

13. The washing machine according to claim 1, wherein the antimicrobial agent has a predetermined dissolving speed when a water is at 25° C., the dissolving speed being set so that an effective concentration of chloride contained in the water after contact with the antimicrobial agent is increased in a range of 0.1 ppm and 10 ppm relative to an effective concentration of chloride contained in the water before the contact with the antimicrobial agent.

14. The washing machine according to claim 1, wherein the water-supply mechanism includes a water supply path for supplying the water from a water source to the wash tub, and the water supply path is provided with a water reservoir, wherein the disposition section is provided in the water reservoir.

15. The washing machine according to claim 1, wherein the water-supply mechanism includes a pouring section for pouring water into the wash tub, wherein the disposition section is provided in the pouring section.

16. The washing machine according to claim 1, further comprising a cassette case allowing water to pass therethrough and detachably attached to the disposition section, wherein the antimicrobial agent is accommodated in the cassette case.

17. The washing machine according to claim 1, wherein the antimicrobial agent contains a rust-proofing component for a material of iron system.

18. The washing machine according to claim 1, wherein the water-supply mechanism includes a bathwater supply path provided for supplying bathwater into the wash tub and a tap water supply path provided for supplying tap water into the wash tub, the washing machine further comprising a control device selectively executing a bathwater supply operation in which water having passed through the bathwater supply path is supplied into the wash tub and a tap water supply operation in which water having passed through the tap water supply path is supplied into the wash tub, wherein a concentration of hypohalogenous acid contained in the water in a wash liquid during the bathwater supply operation is set to be higher than a concentration of hypohalogenous acid contained in the water in the washtub during the tap water supply operation.

* * * * *